United States Patent [19]

Chung et al.

[11] Patent Number: 4,730,439

[45] Date of Patent: Mar. 15, 1988

[54] METHOD AND APPARATUS FOR PACKAGING A PRODUCT IN INDIVIDUAL VACUUM SEALED PACKETS

[76] Inventors: Yun H. Chung; Dennis E. Chung, both of 6125 Wyandotte West, Maumee, Ohio 43557

[21] Appl. No.: 729,152

[22] Filed: Apr. 30, 1985

Related U.S. Application Data

[63] Continuation-in-part of Ser. No. 573,492, Jan. 24, 1984, which is a continuation-in-part of Ser. No. 450,275, Dec. 16, 1982, Pat. No. 4,545,180.

[51] Int. Cl.[4] ..... B65B 31/06; B65B 43/04; B65B 43/20

[52] U.S. Cl. ..... 53/433; 53/434; 53/455; 53/479; 53/481; 53/511; 53/512; 53/373

[58] Field of Search ..... 53/433, 434, 503, 511, 53/512, 455, 469, 473, 479, 481, 562, 563, 371, 372, 373, 266 P; 383/104, 122; 206/604

[56] References Cited

U.S. PATENT DOCUMENTS

| | | | |
|---|---|---|---|
| 2,329,360 | 9/1943 | Salfisberg | 206/604 X |
| 2,691,259 | 10/1954 | Weckesser | 53/563 X |
| 2,691,857 | 10/1954 | Harker | 53/562 X |
| 2,751,732 | 6/1956 | Woppman | 53/373 X |
| 2,754,644 | 7/1956 | Vergobbi et al. | 53/562 X |
| 2,885,846 | 5/1959 | Harker | 53/562 X |
| 3,057,129 | 10/1962 | Meissner | 53/479 X |
| 3,097,459 | 7/1963 | Rausch | 53/503 |
| 3,289,387 | 12/1966 | Stagmeier et al. | 53/512 |
| 3,382,644 | 5/1968 | Vogt | 53/469 X |
| 3,516,223 | 6/1970 | Andersen et al. | 53/512 |
| 3,545,983 | 12/1970 | Woods | 53/433 X |
| 3,553,934 | 1/1971 | Johnson et al. | 53/562 |
| 3,871,157 | 3/1975 | Domke et al. | 53/512 X |
| 3,930,350 | 1/1976 | Reid | 53/455 X |
| 4,216,639 | 8/1980 | Gautier | 53/455 X |
| 4,418,513 | 12/1983 | Plahm | 53/512 X |

*Primary Examiner*—Horace M. Culver
*Attorney, Agent, or Firm*—MacMillan, Sobanski & Todd

[57] ABSTRACT

The present invention relates to a unique method and apparatus for packaging a product in individual vacuum-sealed packets constructed of a sheet of flexible material. In the method of the present invention, a sheet of flexible packaging material is formed into a channel-shaped member having spaced apart vertical sidewalls. The facing surfaces of the sidewalls are sealed at horizontally spaced apart, vertical locations to define a plurality of open top packets. A predetermined amount of a flowable product is introduced into each of the open top packets. Next, the upper corner portions of each individual packet are sealed to reduce the size of the opening in the packets. A vacuum tube is introduced into the open top packet and the upper portion of the open top packet is sealed around the vacuum tube. The interior of the packet is then evacuated through the vacuum tube and an initial horizontal top seal is produced below the vacuum tube to initially seal the packet. Finally, the vacuum tube is retracted and a final horizontal top seal is produced above the initial top seal.

27 Claims, 64 Drawing Figures

20b
20c
20
20a
20d 21
22b
22c
22a
22
22c 22b
22a
22b
22c
22
22a 30b
21
22
30a
30b
30a
30b
22
30a 21
34b
34a
34b
34a
34b
34a 21
38b
38c
38a
38b
38c
38a
38b
38c
38a 39b
21
40
39a
39b
40
39a
39b
40
39a

44

METHOD AND APPARATUS FOR PACKAGING A PRODUCT IN INDIVIDUAL VACUUM SEALED PACKETS

CROSS-REFERENCE TO RELATED APPLICATIONS

The present application is a continuation-in-part of co-pending U.S. patent application Ser. No. 573,492, filed Jan. 24, 1984 and entitled "APPARATUS AND METHOD FOR PACKAGING A PRODUCT IN INDIVIDUAL PACKETS" which is a continuation-in-part of U.S. patent application Ser. No. 450,275, filed Dec. 16, 1982 and entitled "MACHINE FOR MAKING AND FILLING PACKETS AND A PACKET CONTAINING A FLOWABLE PRODUCT", now U.S. Pat. No. 4,545,180, each assigned to the assignee of the present invention, and which are herein incorporated by reference.

BACKGROUND OF THE INVENTION

This invention relates generally to a method and apparatus for packaging a product in individual packets and, more particularly, to a method and apparatus for packaging a product in individual vacuum-sealed packets.

Machines for making and filling packets containing flowable or pulverulent materials such as coffee or catsup, for example, are well known and have been used with a great degree of success. One type of such a machine is disclosed in U.S. Pat. No. 3,404,506. Further, in order to preserve the freshness of a food product and to increase its shelf life, some prior art packaging machines include means for producing a vacuum-sealed packet.

However, there is an ever increasing desire not only to improve the efficiency of such machines to the end that greater production is achieved, but also to produce a simpler and more reliable machine for packaging a product in individual vacuum-sealed packets constructed of a sheet of flexible material.

SUMMARY OF THE INVENTION

The present invention relates to a unique method and apparatus for packaging a product in individual vacuum-sealed packets. The packets are formed from a sheet of flexible packaging material such as paper or plastic suitably coated so that sealing between two contacting sheet portions can be effected with, for example, heated pressure pads.

In particular, the method of the present invention includes forming a flexible sheet of packaging material into a channel-shaped member having spaced apart, generally vertical sidewalls. The facing surfaces of the sidewalls are heat-sealed at horizontally spaced apart, vertically extending locations to define a packet assembly consisting of a plurality of open top packets. During the sealing of the spaced apart vertical side seals, a portion of the sidewalls located between the side seals are maintained in spaced apart relationship. A predetermined amount of a flowable product such as coffee, for example, is then directed into each open top packet.

Next, the upper corners of each packet are heat-sealed to reduce the size of the opening of the packet while, simultaneously, at least a portion of the sidewalls defining the opening are maintained in spaced apart relationship. After the upper corners have been sealed, a slit is cut into the side marginal edge of each packet for assisting a user in opening individual packets. After the side marginal edge of each packet has been slit, a vacuum tube in communication with a source of vacuum is inserted in the open top of the packet and the upper portion of the packet is horizontally stretched and temporarily sealed about the vacuum tube. The interior of the packet is then evacuated through the vacuum tube while, simultaneously, the horizontally extending portion of the side walls located below the vacuum tube are heat-sealed together to produce an initial horizontal top seal for initially closing the packet. Finally, the vacuum tube is removed from the packet and the horizontally extending portion located immediately above the initial top seal is stretched horizontal and heat-sealed together to produce a final horizontal top seal for securely sealing the product in a leak-proof packet.

The apparatus of the present invention includes an initial forming and side sealing station wherein a sheet of flexible packaging material is formed into a channel-shaped member and the sidewalls of the channel-shaped member are sealed at horizontally spaced apart, vertical locations to produce a partially formed packet assembly consisting of a plurality of open top packets. The apparatus includes means for maintaining the intermediate portions of the sidewalls in spaced apart relationship during the side sealing operation. After the side sealing operation, a vacuum transfer unit transfers the partially formed packet assembly to a carriage which is utilized to transport the packet assembly in a horizontal path to a product dispensing or filling station wherein the individual packets are filled with a product.

After the filling operation, the carriage transports the filled packets to a corner sealing station wherein the upper corners of the packets are sealed, and then to a side edge slitting station wherein the side marginal edges of the packets are slit for assisting a user in removing the top portion of the packet from the bottom portion to open individual packets. Next, the packets are transported to a vacuum and initial stretching and sealing station wherein the interior of the packets are evacuated while, simultaneously, an upper portion of the packet is horizontally stretched and an initial horizontal top seal is produced for initially closing the packets. The packets are then transported to a final top stretching and sealing station wherein a final horizontal top seal is produced immediately above the initial top seals to ensure the packets are securely closed. From the final top sealing station, the packets are transported to a separation and release station wherein the packets are separated from one another and then released from the carriage and directed into a suitable shipping container.

The method and apparatus for packaging a product according to the present invention offers several advantages over the known prior art packaging machines. Since the intermediate sidewall portions of the packets are maintained in spaced apart relationship during the vacuum pressure operation, the upper sealing operation of the packet is rendered more difficult due to the fact that the length of sheet material defining the upper marginal edges of the packet is greater than the overall width of the packet. Thus, conventional approaches to sealing the top marginal edges can result in overlapping, wrinkled portions and produce ineffective vacuum seals. The present invention solves this problem by providing a unique approach to sealing the upper end of the open top packet. By first inserting a vacuum tube into the packet and then temporarily sealing the open top of the packet about the vacuum tube, the horizontally extending portion of the sidewalls located below the vacuum tube can be heat-seated to effectively close the packet. Moreover, it has been found that providing a final top seal immediately above the initial top seal produces a more effective top seal for the vacuum packed packet.

The apparatus of the present invention also includes several other features such as, for example, a unique means for metering a predetermined quantity of a product into the packets, which quantity can be varied to suit consumer requirements.

BRIEF DESCRIPTION OF THE DRAWINGS

The above mentioned and other features, objects and advantages, and a manner of obtaining them are described more specifically below by reference to an embodiment of the invention shown in the accompanying drawings, in which:

in FIG. 2*a*, a rectangular sheet of flexible packaging material has been formed into a generally U-shaped channel; in FIG. 2*b*, the facing surfaces of the U-shaped channel have been sealed at selected spaced apart vertical locations to define a plurality of individual open top packets; in FIG. 2*c*, the upper corners of each of the individual packets have been sealed together to reduce the size of the opening of the respective packet; in FIG. 2*d*, the upper portion of each marginal side edge of each individual packet has been slit; in FIG. 2*e*, an intermediate portion of each individual packet has been stretched horizontally and sealed adjacent the product contained in the packets; in FIG. 2*f*, the remaining unsealed top portion of the packet has been stretched horizontally and sealed to securely close the packet; in FIG. 2*g*, a single completed packet is shown after being separated from the group shown in FIG. 2*f*.

in FIG. 3*a*, a predetermined length of flexible packaging material has been cut and is in position to be moved downwardly; in FIG. 3*b*, forming members are moved downwardly to form the flexible sheet of packaging material into a U-shaped channel as shown in FIG. 2*a*; in FIG. 3*c*, a pair of cooperating sealing members have been moved toward one another to seal selected horizontally spaced apart, vertical locations in the U-shaped channel member and define a packet assembly consisting of a plurality of individual open top packets as shown in FIG. 2*b*; in FIG. 3*d*, the forming members and the side sealing members have been retracted and the packet assembly is held by a vacuum holding unit; in FIG. 3*e*, the packet assembly, held by the vacuum unit, has been moved partially downwardly by a transfer assembly; in FIG. 3*f*, the vacuum transfer assembly has positioned the packet assembly within a carriage assembly;

in FIG. 6*a*, the filling mechanism is in the up position and the packets have been positioned by the carriage to receive the product; in FIG. 6*b*, the filling mechanism has been moved downwardly and inserted into the packets; in FIG. 6*c* the packets are maintained in an open position while they are filled;

in FIG. 7*a*, a pair of cooperating corner sealing members are spaced apart and the packet assembly has been positioned therebetween; in FIG. 7*b*, the corner sealing members are moved toward one another to contact the packet assembly and seal the upper corners of each packet as shown in FIG. 2*c*;

in FIG. 8*a*, a pair of cooperating cutting assemblies are in the open position and the packet assembly has been positioned therebetween; in FIG. 8*b*, the cutting assembly has been partially closed such that a plurality of spring biased holding pins are in position to securely hold the upper portions of the packets during the slitting operation; in FIG. 8*c*, the cutting assemblies have been closed and the upper marginal side edges of each individual packet have been slit as shown in FIG. 2*d*;

FIG. 10*a*, taken along line 10*a*—10*a* in FIG. 9*a*, illustrates a packet assembly in position for subsequent operations to be performed; in FIG. 10*b*, the packet assembly is clamped to the carriage, vacuum tubes have been moved to project downwardly into the interior of the packet, and a pair of vacuum sealing pads have been moved inwardly to engage and seal the tops of the packets about the vacuum tubes; in FIG. 10*c*, taken along line 10*c*—10*c* in FIG. 9*b*, the vacuum tubes have been partially retracted; in FIG. 10*d* the initial top sealing means has been moved into engagement with the packet to produce an initial horizontal top seal immediately below the vacuum tube;

in FIG. 12*a*, taken along line 12*a*—12*a* in FIG. 10*a*, a pair of cooperating stretching and vacuum sealing devices are shown in open position and the packet assembly has been positioned therebetween; in FIG. 12*b*, the stretching and vacuum sealing devices have been partially moved toward one another and clamping fingers have engaged opposite marginal edges of the packet assembly; in FIG. 12*c*, taken along line 12*c*—12*c* in FIG. 10*b*, the stretching and vacuum sealing device have been moved further toward one another to stretch the top of each packet and seal the packet opening around the vacuum tube; FIG. 12*d*, taken along line 12*d*—12*d* in FIG. 12*a*, illustrates the working surface of one of the stretching and vacuum sealing devices; FIG. 12*e*, taken along line 12*e*—12*e* in FIG. 12*a* illustrates the working surface of the cooperating stretching and vacuum sealing device;

in FIG. 13*a*, taken along line 13*a*—13*a* in FIG. 10*c*, a pair of cooperating top heat sealing members are shown in an open position and the packet assembly has been positioned therebetween; in FIG. 13*b*, the heat sealing members have been moved toward one another to seal the intermediate unclosed portion of the packets as shown in FIG. 2*e*; FIGS. 13*c* and 13*d*, taken along lines 13*c*—13*c* and 13—13*e* in FIG. 13*a* respectively, illustrate the cooperating surfaces of the heat sealing members;

in FIG. 14*a*, a pair of cooperating top sealing devices are in the open position and the packet assembly has been positioned therebetween; in FIG. 14*b*, the sealing devices have been moved partially toward one another and a pair of clamping fingers have engaged the opposite top marginal portions of the packet assembly for stretching the top of the packets; in FIG. 14*c*, the sealing devices have been moved further toward one another to stretch and seal the remaining unclosed top portion of the packets as shown in FIG. 2*f*;

FIG. 14*d* is a cross-sectional view taken along the line 14*d*—14*d* in FIG. 14*a* and illustrating the clamping fingers in an open position; FIG. 14*e* is a cross-sectional view taken along line 14*e*—14*e* in FIG. 14*c* and illustrating the clamping fingers in clamping position; FIGS. 14*f* and 14*g* taken along lines 14*f*—14*f* and 14*g*—14*g* in FIG. 14*a*, respectively, illustrate the facing surfaces of the cooperating final stretching and heat sealing devices;

in FIG. 15*c*, the carriage opening arm has been moved downwardly to open the carriage jaws and release the packets.

DETAILED DESCRIPTION OF THE PREFERRED EMBODIMENT

The machine constructed in accordance with the present invention produces vacuum sealed packets or pouches filled with a flowable material, such as, for example, sugar, coffee, mayonnaise, or catsup. The packets are formed of paper suitably coated so that sealing can be effected with heat. Also, cold pressure sensitive material can be employed. Other than paper, the sheet material may be plastic, foil, metal foil, or combinations thereof, depending upon the product to be packaged.

Figure 1:
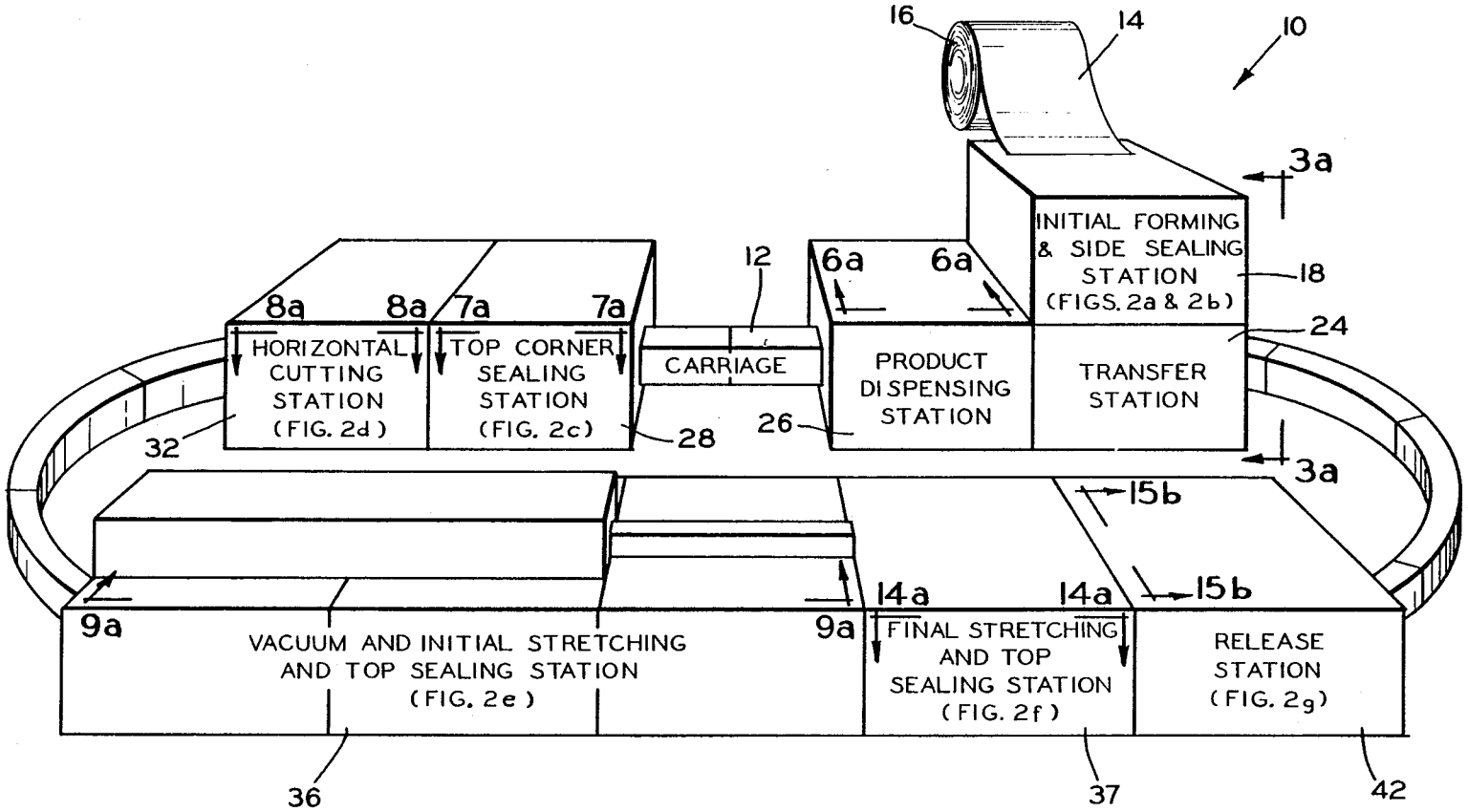
FIG. 1 is a block diagram illustrating the various stations which are included in the packaging apparatus of the present invention.

FIG. 1, shown as a block diagram, illustrates a packet forming machine 10 contemplated by the present invention. The block diagram of FIG. 1 will be utilized in conjunction with packets illustrated in various stages of construction in FIGS. 2*a* through 2*g* to generally describe the method by which the individual packets are formed. A more detailed explanation of the mechanisms and components utilized to perform the method will be discussed hereinafter.

Referring to FIG. 1, the packaging machine 10 includes a plurality of individual stations which are adapted to perform selective operations in transforming a sheet of flexible packaging material into a plurality of individual filled packets. As will be discussed, the packets are transported from one station to another by means of a carriage assembly 12.

In FIG. 1, a flexible strip 14 of packaging material on a supply roll 16 is supplied to an initial forming and side sealing station 18. The initial forming station 18 is adapted to sever a predetermined length of the flexible strip 14 and to form the severed rectangular portion into a generally U-shaped channel 20 as shown in FIG. 2*a*.

Figures 2A, 2B, 2C, 2D, 2E, 2F, 2G:
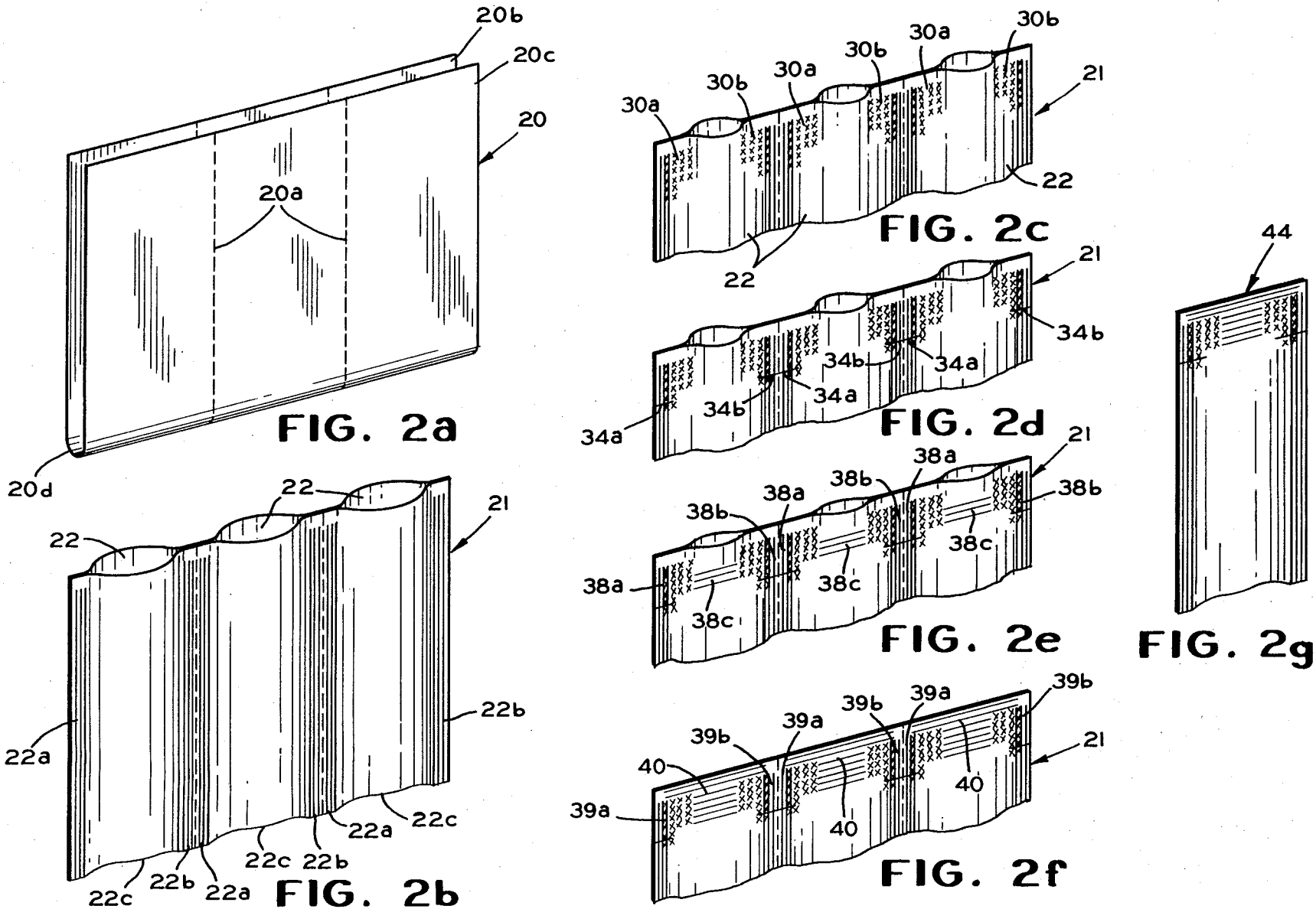
FIGS. 2*a*, 2*b*, and 2*g* are full perspective views
FIGS. 2*c* through 2*f* are fragmentary perspective views showing, in sequence, the various steps utilized to transform a sheet of packaging material into a plurality of individual sealed packets each containing a predetermined amount of a flowable product.

Prior to severing the strip 14, the station 18 forms perforated lines 20*a* in the strip 14, as shown in FIG. 2*a*, to define the lines along which the individual packets will subsequently be separated. In FIG. 2*a*, the U-shaped channel 20 includes spaced apart generally parallel sidewalls 20*b* and 20*c* and a lower bottom portion 20*d*.

After the U-shaped channel 20 of FIG. 2*a* is formed, selected portions of the spaced apart sidewalls 20*b* and 20*c* which define the side marginal edges of the individual packets are sealed in a manner as shown in FIG. 2*b* to define a packet assembly 21 comprising a plurality of individual spaced apart open top packets 22 having side seals 22*a* and 22*b*. As will be discussed, the portions of the spaced apart sidewalls 20*b* and 20*c* which are intermediate the side seals 22*a* and 22*b* are maintained in a spaced apart relationship during the sealing operation of FIG. 2*b* such that the packets have a bottom portion 22*c* spaced upwardly from the lower ends of the side seals 22*a* and 22*b*. By maintaining the sidewalls of the packet in spaced apart relationship during the initial sealing operation, more product is able to be packaged in a packet constructed of a given amount of packaging material.

After the individual packets 22 have been formed in a manner as shown in FIG. 2*b*, the packet assembly is transferred to the carriage 12 by means of a vacuum transfer assembly 24. The carriage 12 securely holds the packet assembly 21 and is coupled to a suitable drive mechanism (not shown) for transporting the packet assembly to the remaining forming stations. Initially, the carriage 12 transports the packet assembly 21 to a product dispensing station 26 at which point each of the individual packets 22 are filled with a predetermined amount of a product. After the packets have been filled, the packets are transported to a corner sealing station 28 wherein the upper corner portion of each individual packet 22 is sealed in areas 30*a* and 30*b*, as shown in FIG. 2*c*, to partially close the open top of the packets 22.

Next, the packet assembly 21 is transported to a horizontal cutting station 32 wherein, as shown in FIG. 2*d*, the side seals of each individual packet 22 are cut to define slit portions 34*a* and 34*b* which assists a user in opening a sealed packet. It has been found that such a slit greatly assists a user in opening the individual packets. For example, the packet can be easily opened by the user by grasping the upper corner of a packet between the thumb and forefinger of one hand and grasping the respective side seal between the thumb and forefinger of the opposite hand and ripping the top portion away from the remaining portion of the packet.

After the side seals are slit, the packet assembly 21 is transported to a vacuum and initial top stretching and sealing station 36. The packet assembly illustrated in FIG. 2*e* is formed at the station 36, by initially compressing, shaping, and clamping each individual packet 22 to the carriage 12 and then inserting a vacuum tube into the interior of each individual packet 22. Next, intermediate upper side areas 38*a* and 38*b* (see FIG. 2*e*) disposed above the product contained in the packet are pulled away from one another, thereby stretching an intermediate portion of the packet extending between side seal areas 38*a* and 38*b* and causing the facing surfaces of the packets, which are spaced apart as shown in FIG. 2*d*, to come toward one another, as shown in FIG. 2*e*. After the packet has been stretched the open top of the packet is sealed around the vacuum tube. The vacuum tube is then partially retracted and the unsealed portion extending between the side seal areas 38*a* and 38*b* is sealed to initially close the packet, as illustrated in FIG. 2*e* as initial top seal 38*c*.

After the vacuum and initial stretching and sealing operation, the packet assembly is transported to a final top stretching and sealing station 37. As shown in FIG. 2*f*, the final operation performed by the station 37 consists of pulling the upper corner areas 39*a* and 39*b* away from one another, thereby stretching the upper top portion and causing the upper marginal edges of the packets, which are spaced apart as shown in FIG. 2*e*, to come toward one another, as shown in FIG. 2*f*. After the top portion has been stretched, the remaining unsealed portion extending between the side areas 39*a* and 39*b* of the top can be completely sealed to close the packet, as shown in FIG. 2*f* as final top seal 40.

After the packets have been completely sealed, the carriage 12 transports the packet assembly to a packet separation and release station 42 wherein the individual packets can be first separated from one another along perforated lines 20*a* and then released from the carriage 12. As the separated packets are released from the carriage 12, they can be directed into a suitable shipping container (not shown). An individual completed completely sealed packet 44 is shown in FIG. 2*g*.

The individual stations which are schematically represented in FIG. 1 will now be discussed in more detail. It should be noted that the drive mechanisms utilized to operate the components of the individual stations are synchronized with one another such that when one station is performing an operation on a selected group of packets, the other stations are performing selected operations on other groups of packets. It will be appreciated that, after a thorough review of the components and the operations performed by each individual station, the manner in which the individual stations can be synchronized with one another through appropriate drive mechanisms and linkages is obvious to one of ordinary skill in the art.

Referring to FIGS. 3*a* through 3*f* and FIGS. 4*a* through 4*e*, there is shown the initial packet forming and side sealing station 18 and the vacuum transfer assembly 24. The sheet material 14 from the supply spool 16 is directed by a series of rollers 50*a* through 50*d* onto the upper surface of a cutting platform 52. A shaft 54 having a plurality of spaced apart circular cutting blades 54*a* maintained thereon (shown in FIG. 4*e*) is adapted to form the individual perforated cuts 20*a* (shown in FIG. 2*a*) in the sheet material 14. Typically, the supply roll 16 and the shaft 54 are driven at the same speed and the roller 50*d* is driven at a slightly faster speed, while the rollers 50*a*, 50*b*, and 50*c* function as idlers.

Figure 3A:
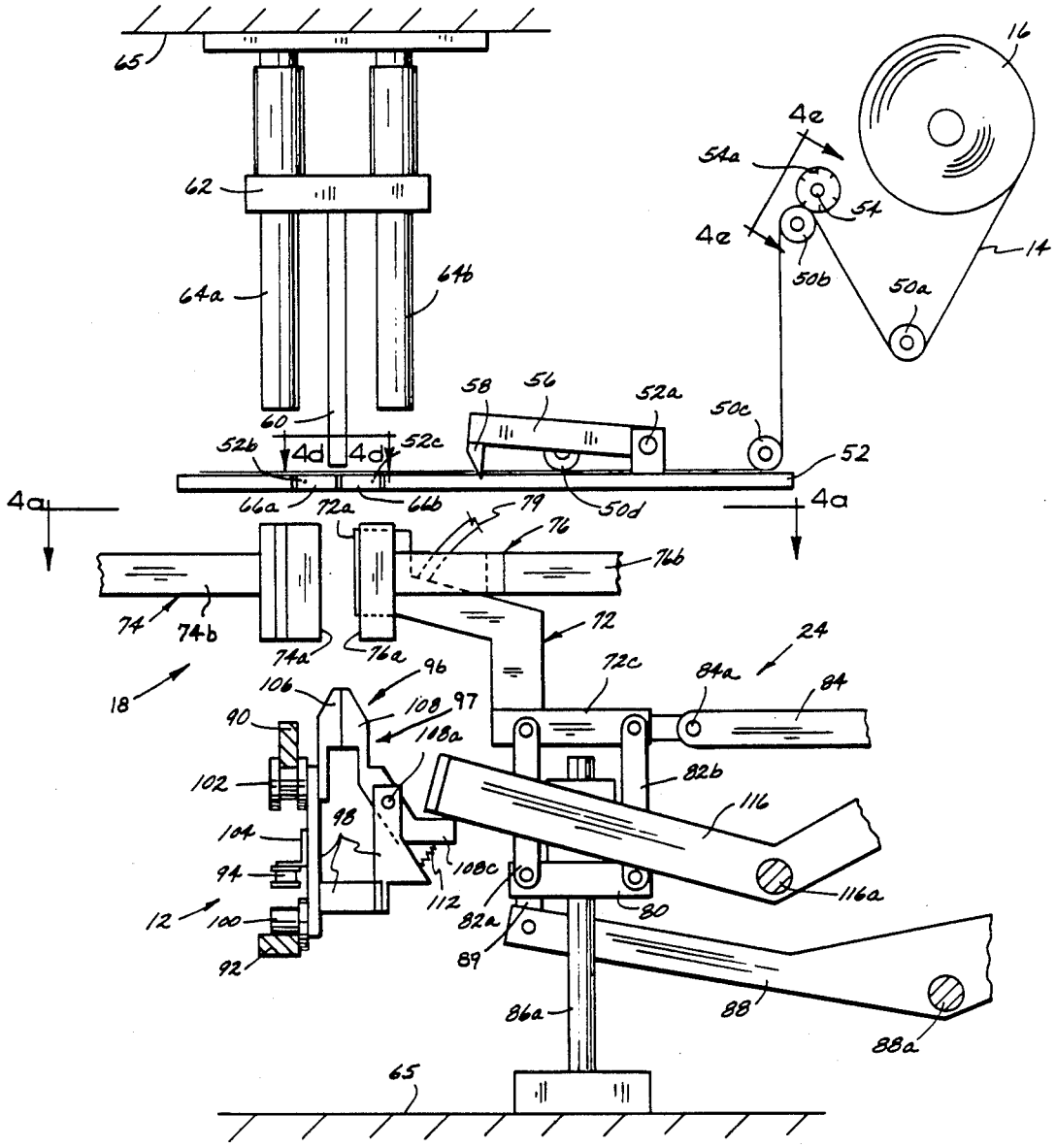
FIGS. 3*a* through 3*f* are sectional views which illustrate, in sequence, the operations of the initial packet forming and side sealing stations of FIG. 1 utilized in producing the packet assembly as shown in FIG. 2*b*.

A cutting arm 56 has one end pivotally mounted relative to the cutting platform 52 at 52*a* and has a cutting blade 58 mounted on the opposite end thereof. The cutting arm 56 is coupled to a suitable drive mechanism (not shown) which is synchronized with the main drive of the machine for controlling the movement of the cutting arm 56. When a predetermined length of the sheet 14 has been fed past the cutting blade 58, the cutting arm 56 is moved downwardly as shown in FIG. 3*a* to sever a predetermined length of the sheet 14.

Figure 4A:
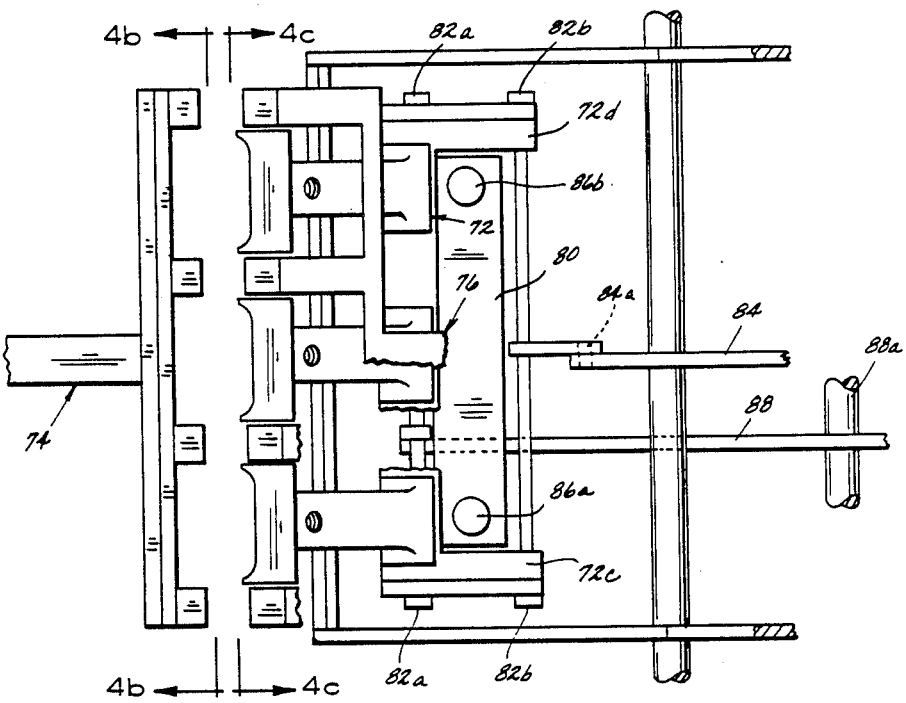
FIG. 4*a* is a sectional view taken along the line 4*a*—4*a* in FIG. 3*a* and illustrating a top view of the side sealing members and the vacuum transfer assembly.
Figure 4B:
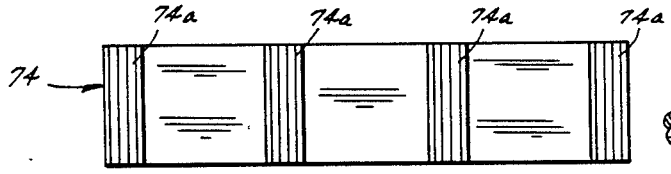
FIG. 4*b* is a sectional view taken along the line 4*b*—4*b* in FIG. 4*a* and illustrating the surface of one of the side sealing members which faces the packet assembly.
Figure 4E:
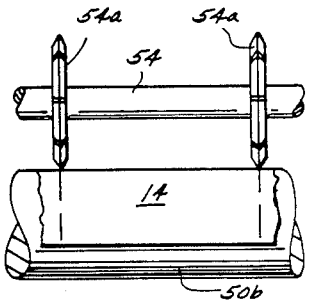
FIG. 4*e* is an elevational view taken along the line 4*e*—4*e* of FIG. 3*a* and illustrating the spaced apart circular cutters utilized to form the perforated lines in the sheet of packaging material.
Figure 4C:
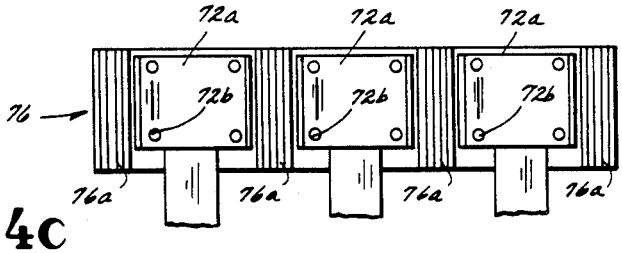
FIG. 4*c* is a sectional view taken along the line 4*c*—4*c* in FIG. 4*a* and illustrating the surface of the vacuum holding unit which faces the packet assembly.
Figure 4D:
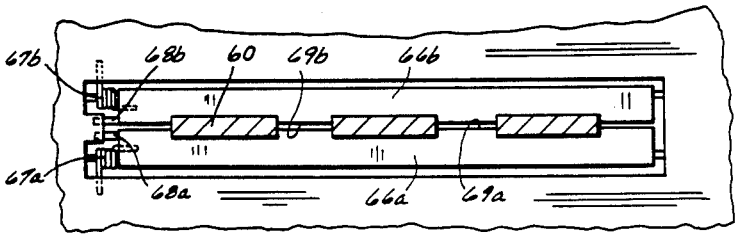
FIG. 4*d* is a sectional view taken along the line 4*d*—4*d* of FIG. 3*a* and illustrating the cross-sectional configuration of the vertical forming members.

A plurality of downwardly extending forming members 60 (having a cross-section as illustrated in FIG. 4*d*) are mounted on a support 62 slidably mounted on a pair of spaced apart vertical guide shafts 64*a* and 64*b*. The guide shafts 64*a* and 64*b* are secured relative to the main frame 65 of the machine. As shown in FIGS. 3*a* and 4*d*, a pair of elongate forming flaps 66*a* and 66*b* are located immediately below the forming members 60 and are pivotally attached to the cutting platform 52 at 52*b* and 52*c*, respectively. The flaps are biased upwardly by springs 67*a* and 67*b* and are maintained in a normally horizontal position by means of stop members 68*a* and 68*b* respectively. The extreme outer ends 69*a* and 69*b* of the flaps 66*a* and 66*b*, respectively, define an elongate aperture through which the sheet is forced.

Figure 3B:
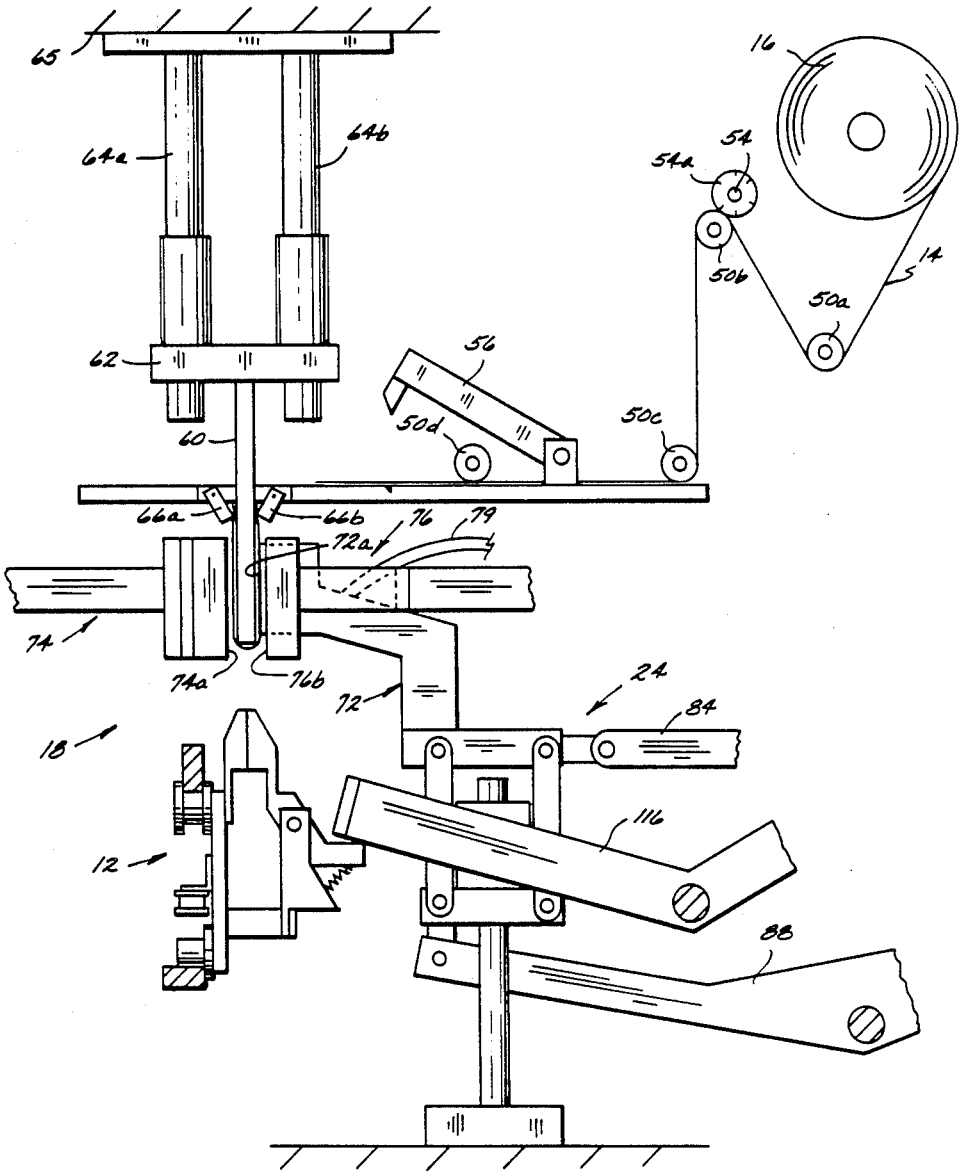

Once the sheet has been cut by the cutting blade 58, the support 62, which is connected to a suitable synchronized drive mechanism (not shown), causes the members 60 to move downwardly, as shown in FIG. 3*b*, such that the forming flaps 66*a* and 66*b* are pivoted downwardly and the severed portion of the sheet 14 is forced between the flaps 66*a* and 66*b* to form the U-shaped channel as shown in FIG. 2*a*. The forming members are moved downwardly such that the U-shaped channel is frictionally held by the forming flaps 66*a* and 66*b* and is positioned between a pair of spaced apart side sealing members 74 and 76.

Figure 3C:
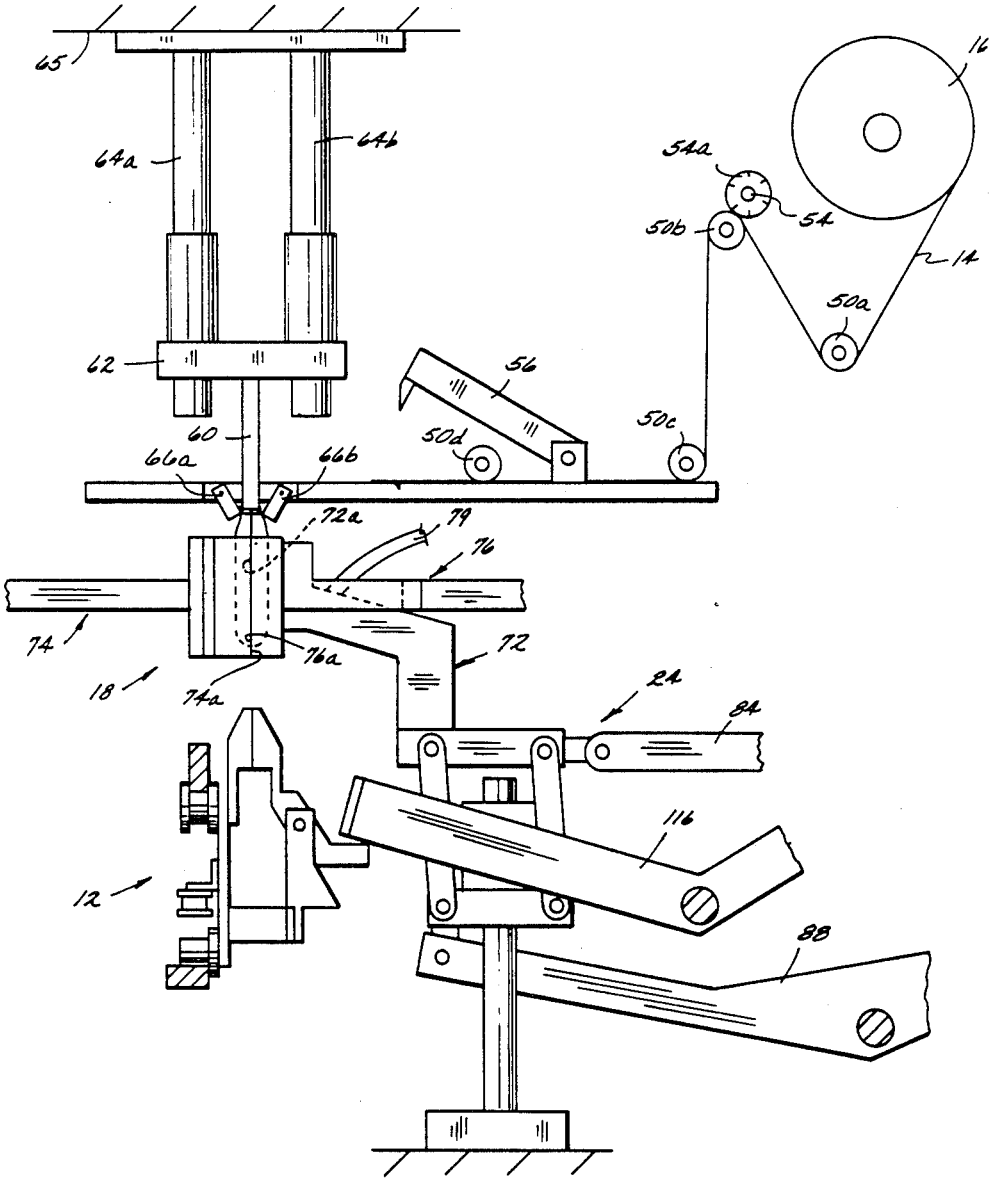

As shown in FIGS. 4*a*, 4*b*, and 4*c*, the side sealing members 74 and 76 have spaced-apart heated sealing pads 74*a* and 76*a* respectively for engagement with selected portions of the U-shaped channel to cause selected facing portions of the sidewalls to be pressed into engagement with one another. The side sealing members 74 and 76 include arms 74*b* and 76*b*, respectively, which are connected to a suitable synchronized drive mechanism (not shown) for moving the sealing members 74 and 76 toward and away from one another. After the forming members have been moved downwardly as shown in FIG. 3*b* to form the U-shaped channel, the side sealing members are moved toward one another, as shown in FIG. 3*c*, to cause selected portions of the facing surfaces of the U-shaped channel to seal to one another in a manner shown in FIG. 2*b*. During the side sealing operation, the vertical forming members remain in the down position to maintain the intermediate portions of the sidewalls of the packets in a spaced apart relationship.

As previously mentioned, the vacuum transfer assembly 24 is utilized for transferring the packet assembly having the side seals formed therein from the initial forming and side sealing station 18 to the carriage 12 which transports the packet assembly to the other forming stations. As shown in FIGS. 3*a*, 4*a*, and 4*c*, the vacuum transfer assembly 24 includes a vacuum head unit 72 having a plurality of individual vacuum heads 72*a* utilized for supporting a packet assembly as it is transferred to the carriage 12. The individual vacuum heads 72*a* have apertures 72*b* formed therein which are connected by lines 79 to a source of vacuum (not shown). As best shown in FIG. 4*a*, the vacuum head unit 72 includes a pair of spaced apart lower arms 72*c* and 72*d* connected to a vertically slidably mounting member 80 (see FIG. 3*a*) by means of two spaced apart pairs of linkage arms 82*a* and 82*b*. The horizontal position of the vacuum head unit 72 is controlled by means of a horizontal control arm 84 pivotally connected to the vacuum head unit at 84*a*. The mounting member 80 is slidably mounted on a pair of vertical guide shafts 86*a* and 86*b* which are secured relative to the main frame 65 of the machine. The vertical position of the vacuum head unit 72 is controlled by means of a vertical control arm 88 pivoted about point 88*a* and pivotally connected to the mounting member 80 by means of a connecting link 89.

Figure 3D:
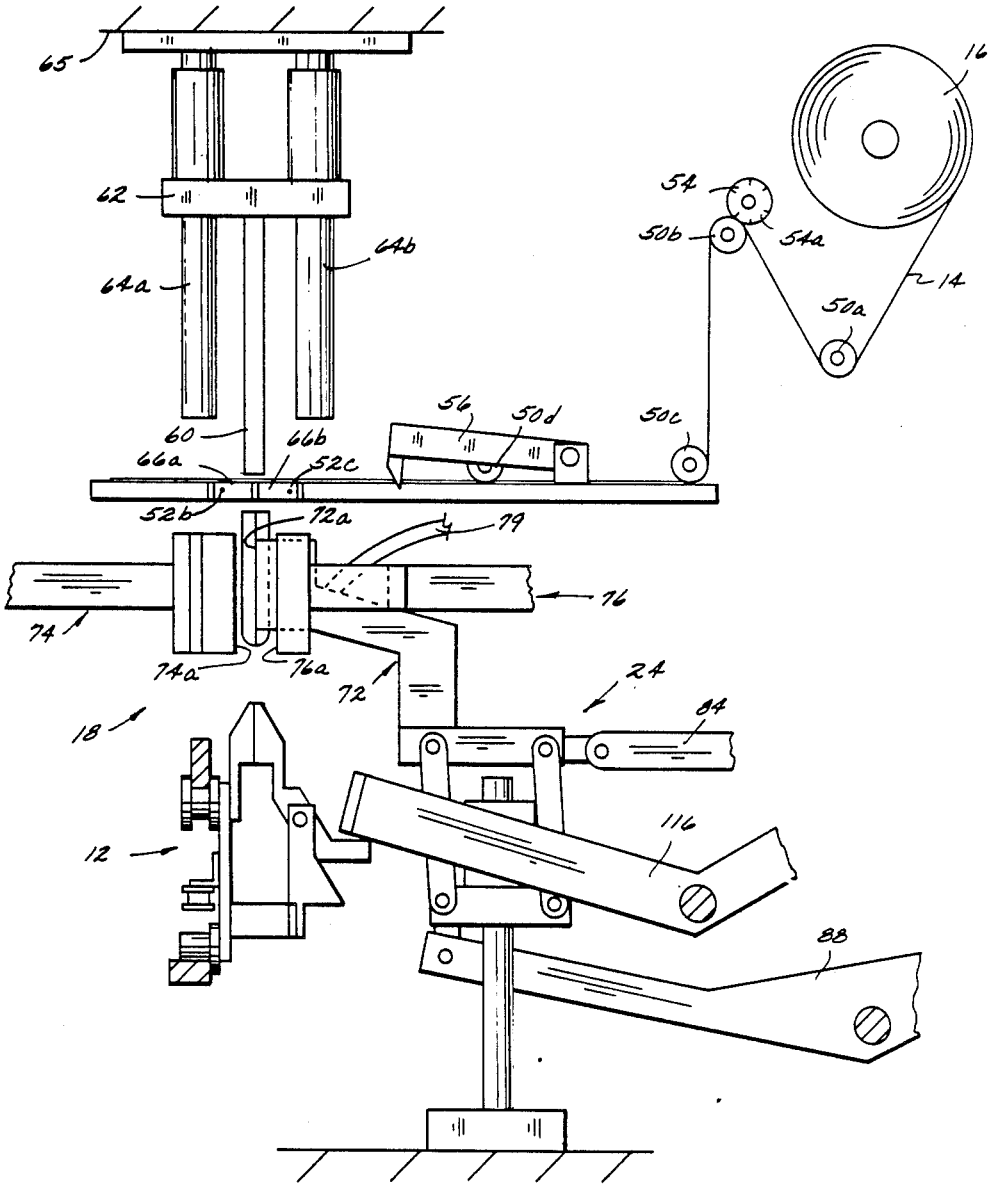
Figure 3E:
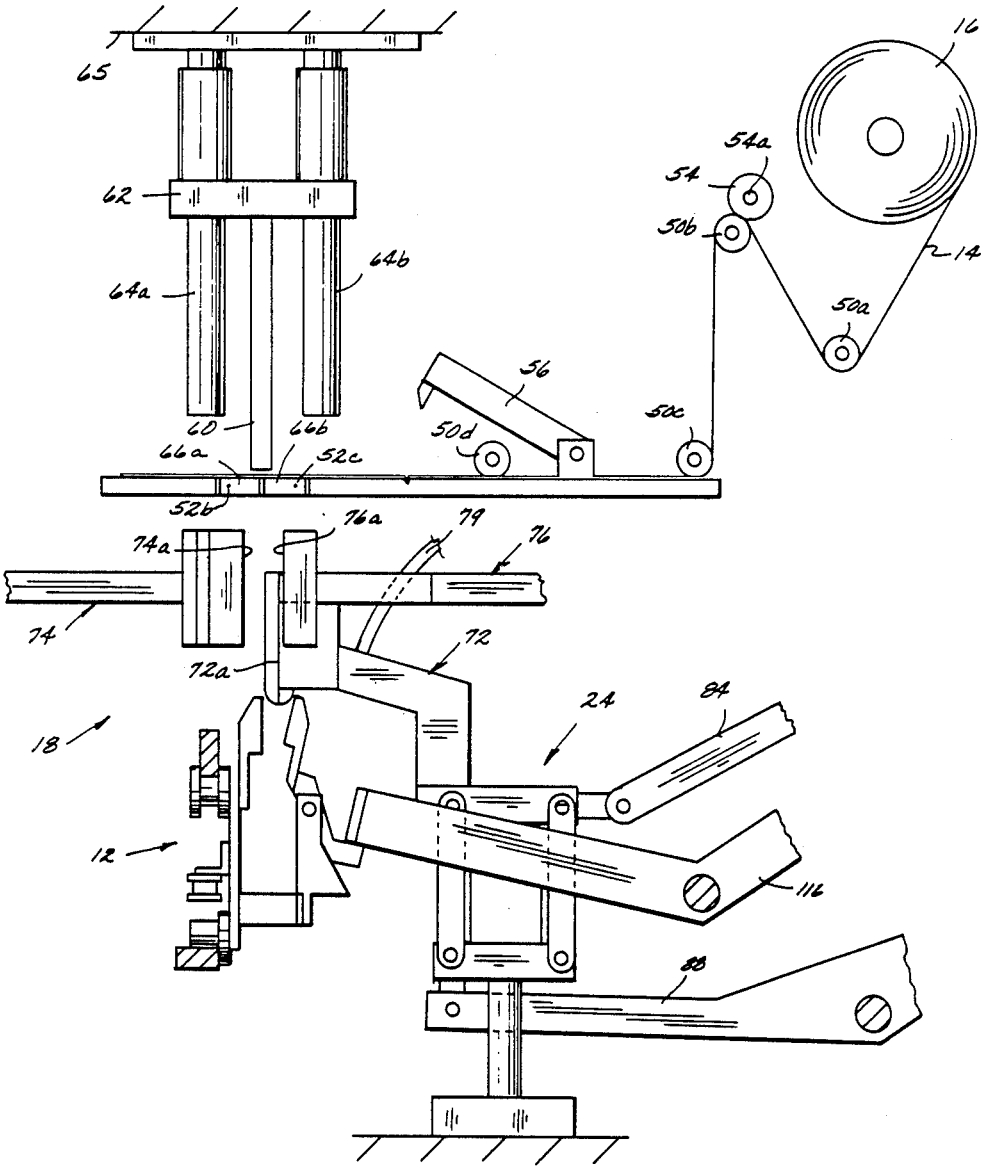

After the side sealing members 74 and 76 have been moved toward one another to effect the side sealing operation as shown in FIG. 3*c*, the vacuum head unit 72 is moved inwardly adjacent the packet assembly and vacuum is applied to the vacuum heads 72*a* to pull the packet assembly against the vacuum heads. When the vertical forming members 60 and side sealing members 74 and 76 have been retracted, as shown in FIG. 3*d*, the packet assembly will be supported entirely by the vacuum head unit 72. The control arms 84 and 88 are then operated to move the vacuum heads and the packet assembly downwardly, as shown in FIG. 3*e*, toward the carriage 12.

Figure 5:
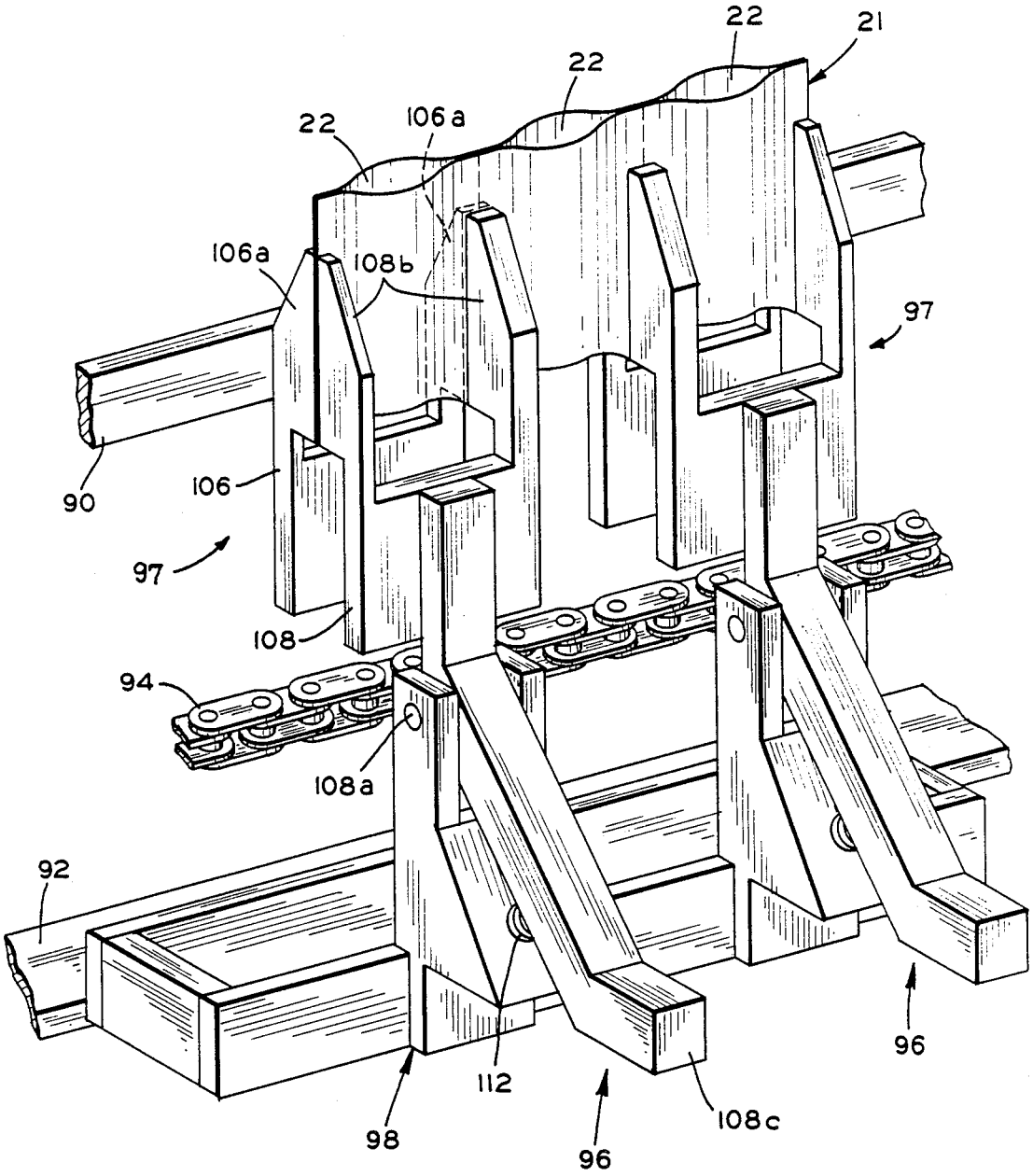
FIG. 5 is a perspective view of the carriage assembly utilized to transport a packet assembly from one station to another.

The carriage 12 utilized to transport the packet assemblies from station to station is best shown in FIGS. 3*a* and 5. Basically, the direction of travel of the carriage 12 is controlled by a pair of guide rails 90 and 92, while the carriage is driven by a chain 94. The carriage 12 includes a plurality of individual holding units 96 of the type illustrated in FIG. 5, each of which is adapted to hold a separate packet assembly. In instances wherein the length of a packet assembly is greater than the holding capacity of a single holding unit, a plurality of adjacent holding units can be used to support a single packet assembly.

As shown in FIG. 3*a*, each individual holding unit 96 includes a main body 98 having a lower roller 100 which engages the lower guide rail 92 and an upper roller 102 which engages the upper guide rail 90. The main body is secured to the chain 94 by a bracket 104.

As shown in FIG. 5, each holding unit 96 includes an upper clamping assembly 97 utilized for releasably supporting each packet 22 of a packet assembly 21. The clamping assembly 97 includes a fixed jaw member 106 secured to the main body 98 and having a pair of spaced apart vertical clamping fingers 106*a*. A movable jaw member 108 is pivotally mounted to the main body 98 at 108*a*. The jaw member 108 includes spaced clamping fingers 108*b* which engage clamping fingers 106*a* of the fixed jaw member 106. As shown in FIG. 5, the clamping fingers are adapted to engage the packet assembly at locations which constitute the side seals of the individual packets.

The pivotally mounted jaw member 108 includes a lower release arm 108*c* for pivoting the jaw member about the pivot point 108*a*. A spring 112 is connected between the jaw member 108 and the main body 98 and is utilized to bias the jaw member into a clamping position.

Figure 3F:
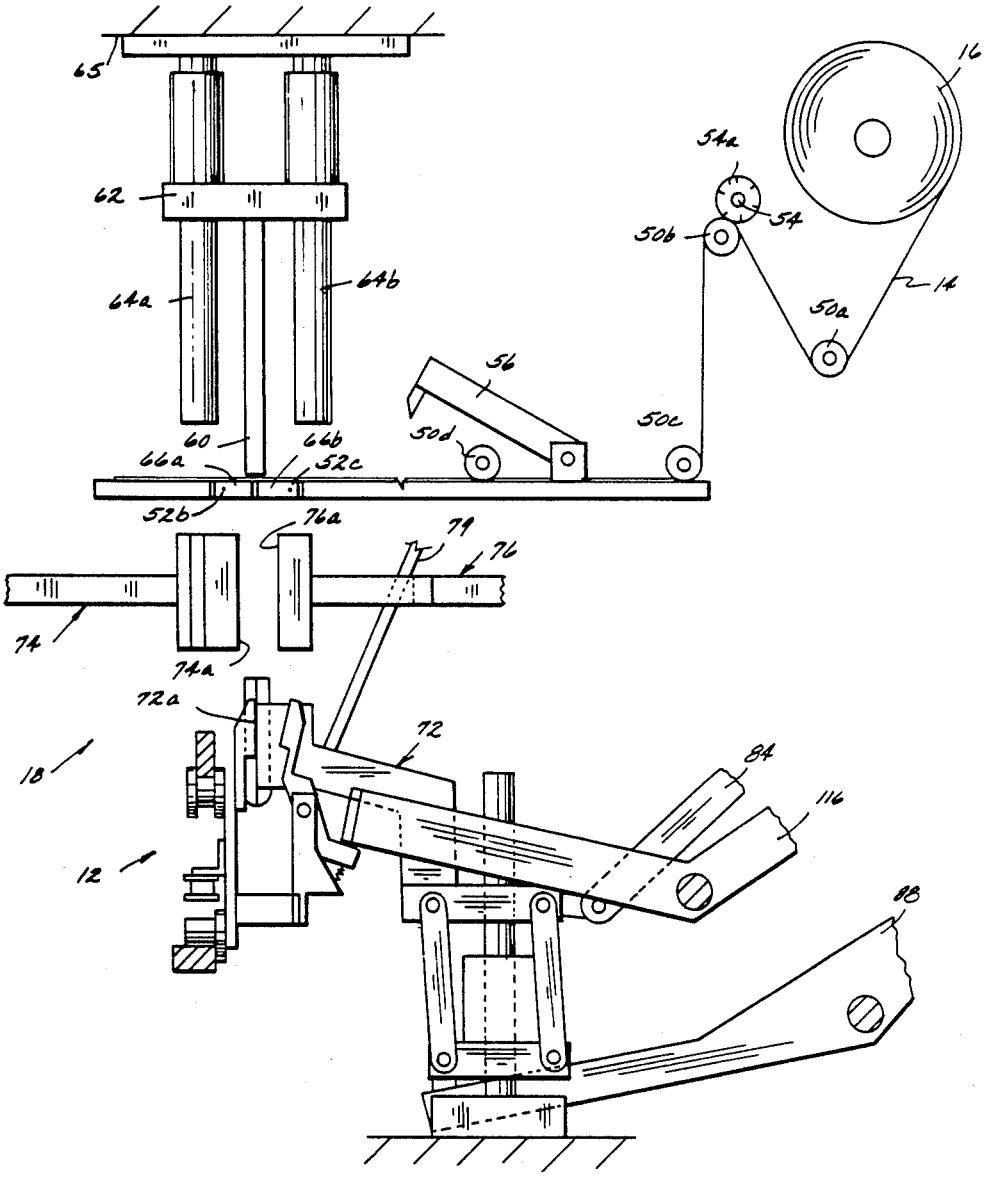

Once the side sealing members 74 and 76 have been retracted such that the packet assembly is held solely by the vacuum head unit 72, the vacuum head unit 72 can transfer the packet assembly to the carriage 12. As shown in FIG. 3*e*, as the packet assembly begins to move downwardly to the carriage 12, a release lever 116 connected to a suitable drive mechanism pivotally mounted at 116*a* relative to the main frame of the machine engages the release arm 108*c* and pivots the jaw member 108 to cause the clamping assembly to open. Next, the horizontal control arm 84 and the vertical control arm 88 are manipulated to move the vacuum head unit 72 to position the packet assembly as shown in FIG. 3*f*, at which time the release lever 116 can be pivoted to allow the clamping jaws to securely engage the packet assembly. The vacuum head unit 72 can then return to its upper position as shown in FIG. 3*a*. Once the packet assembly has been positioned within the carriage 12, the carriage can be moved to transport the packet assembly to the product dispensing station 26.

Figure 6A:
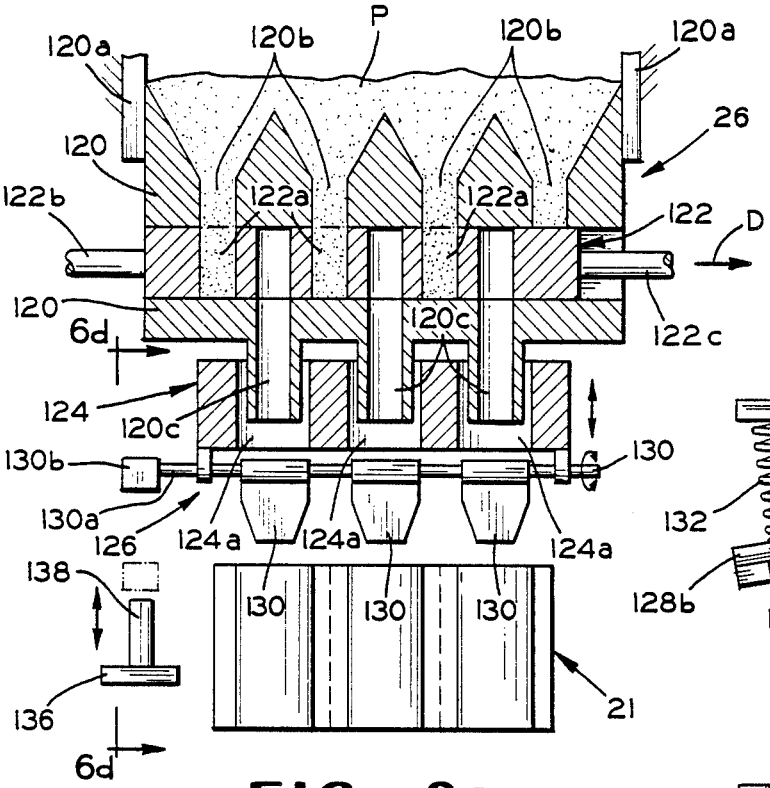
FIGS. 6*a*, 6*b* and 6*c* illustrate the sequence of operations of the product dispensing station of FIG. 1 in filling the individual packets with a product.
Figure 6D:
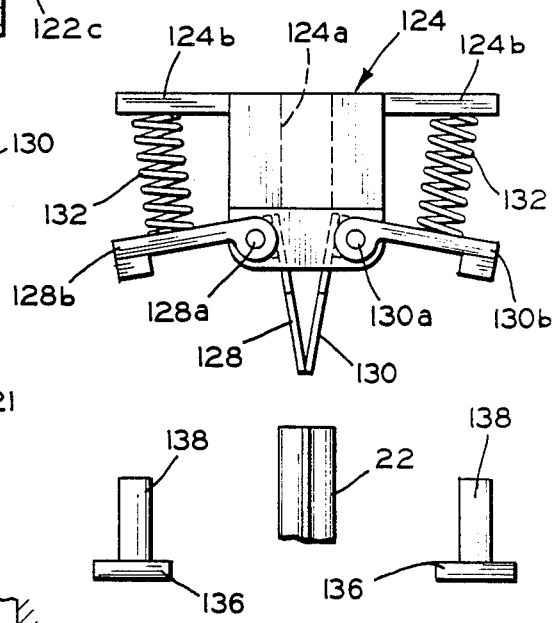
FIG. 6*d* is an elevational view taken along line 6*d*—6*d* in FIG. 6*a* and illustrating the uppermost position of the filling mechanism.
Figure 6B:
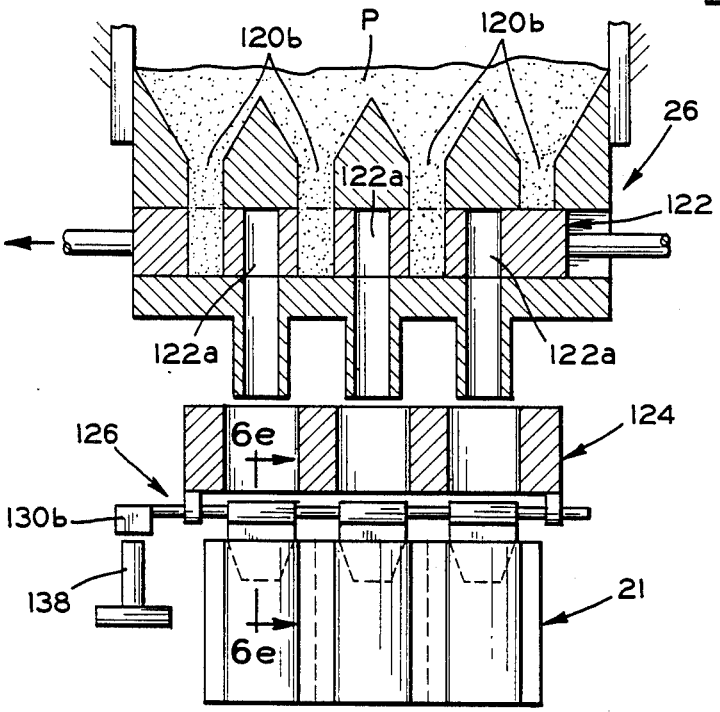
Figure 6E:
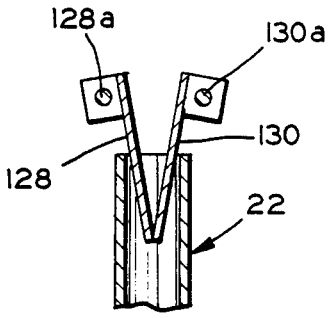
FIG. 6*e* is a sectional view taken along line 6*e*—6*e* in FIG. 6*b* and illustrating the packet opening arms inserted into the packets, but in their closed position.
Figure 6C:
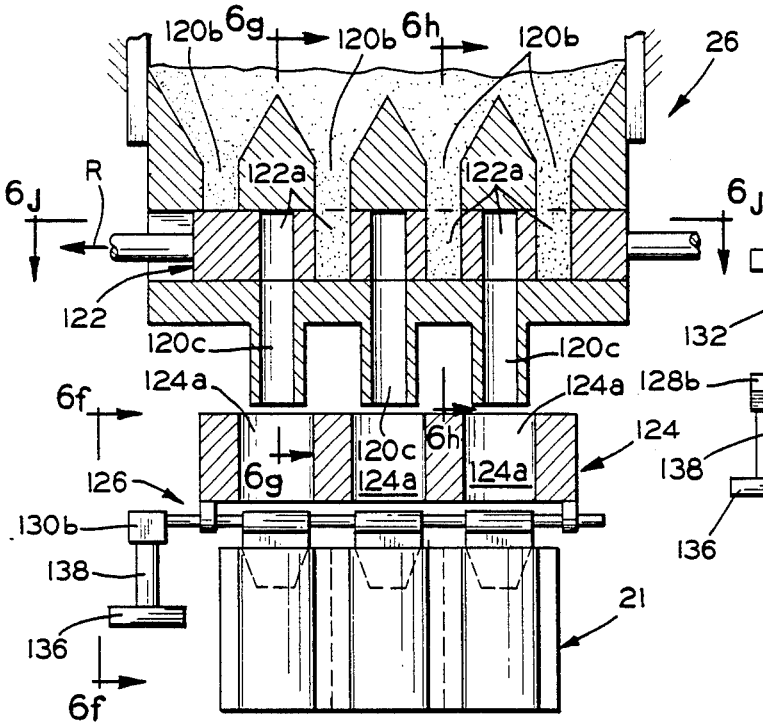

The product dispensing station 26 is shown in more detail in FIGS. 6*a* through 6*j*. The product dispensing station 26 includes a hopper unit 120 containing a supply of flowable product P, a horizontally reciprocal metering apparatus 122, and a vertically reciprocal funnel device 124. The hopper unit 120 is fixed to the main frame 65 of the machine by mounting members 120*a* and has a plurality of openings 120*b*, each of which directs the flowable product P into those ones of a plurality of metering chambers 122*a* of the metering apparatus 122 which are positioned directly below the openings 120*b*. The hopper unit 120 also includes a plurality of dispensing outlets 120*c*, each of which is adapted to direct metered amounts of the flowable product from those metering chambers positioned directly above the outlets 120*c* into the vertically reciprocal funnel device 124. As will be discussed, the funnel device 124 includes means for maintaining the top of the packets in an open position during the dispensing operation. When a packet assembly 21 is suitably positioned below the funnel device 124, the metering apparatus 122 is moved horizontally in one direction (as represented by arrow D in FIG. 6*a*) by arms 122*b* and 122*c* to cause the chambers 122*a* which are aligned with the openings 120*b* (as shown in FIG. 6*a*) to move into position above the outlets 120*c* (as shown in FIG. 6*c*) such that a predetermined quantity of a product is dispensed through each opening 120*c* and the openings 124*a* of the funnel device 124 into the packets. When the next set of packets is suitably positioned, the metering apparatus is then moved in the opposite horizontal direction (as represented by arrow R in FIG. 6*c*) to dispense the product.

Figure 6F:
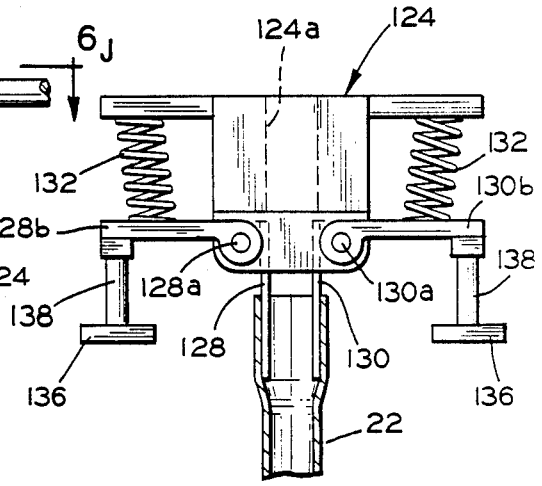
FIG. 6*f* is an elevational view, partly in section, taken along line 6*f*—6*f* in FIG. 6*c* and illustrating the packet opening arms in their open position.

The funnel device 124 is connected to a suitable drive mechanism (not shown) for vertically positioning the funnel device 124 relative to the packet assembly 21. The funnel device 124 also includes an opening mechanism 126 which is utilized to ensure that each of the packets 22 is fully opened when the product is dispensed. The opening mechanism 126 includes a number of pairs of opening members 128 and 130 fixedly mounted on shafts 128*a* and 130*a* which are rotatably journalled on the lower surface of the funnel device 124 on opposite sides of the associated funnel outlets 124*a* as shown in FIGS. 6*d* and 6*f*.

When the opening mechanism 124 is in the up position as shown in FIGS. 6*a* and 6*d*, the lower ends of the members contact one another. The opening mechanism 124 also includes arms 128*b* and 130*b* fixedly mounted on an end of the shafts 128*a* and 130*a*, respectively, for rotating the shafts. A spring 132 disposed between each arm 128*b* and 130*b* and members 124*b* projecting from the body of the funnel 124 biases the opening members 128 and 130 to a closed position.

Horizontal support plates 136 fixed relative to the main frame 65 of the machine are utilized to support separate upstanding post members 138 which cooperate with the biasing arms 128*b* and 130*b* to rotate the opening members 128 and 130 away from each other. When the carriage 12 has positioned the packet assembly 21 below the funnel device 124 as shown in FIG. 6*a*, the funnel device 124 and opening mechanism 126 are moved downwardly as shown in FIG. 6*b*. As the opening members 128 and 130 move downwardly, they are inserted into openings at the top of the packet, as shown in FIG. 6*e*. As the outer ends of the biasing arms 128*b* and 130*b* of the opening elements 128 and 130 contact the upper ends of the actuating posts 138, the opening elements are pivoted about their respective pivot shafts, causing the opening members to move away from the one another, as shown in FIG. 6*f*, thereby ensuring that the packet is sufficiently opened to permit the dispensed product to be discharged into the packet.

Figure 6J:
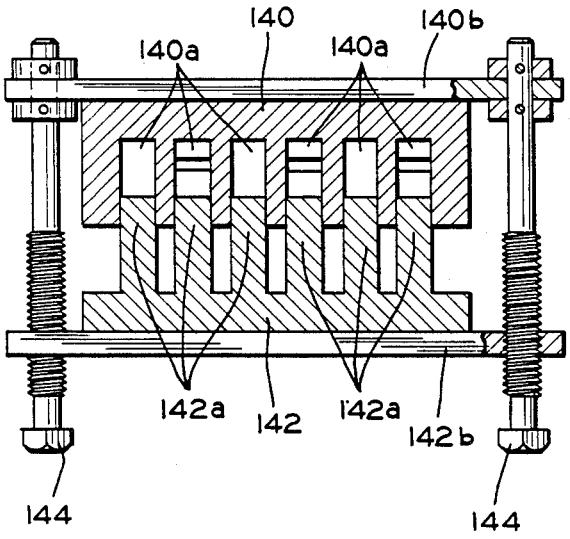
FIG. 6*j* is a cross-sectional view taken along line 6*j*—6*j* in FIG. 6*c* and further illustrating the product metering mechanism.
Figure 6G:
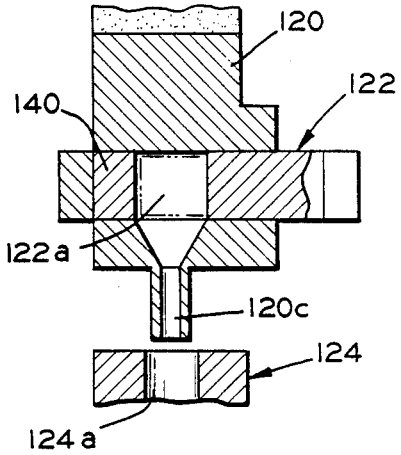
FIGS. 6*g* and 6*h* are sectional views taken along lines 6*g*—6*g* and 6*h*—6*h*, respectively, in FIG. 6*c* and illustrating the product metering mechanism.
Figure 6H:
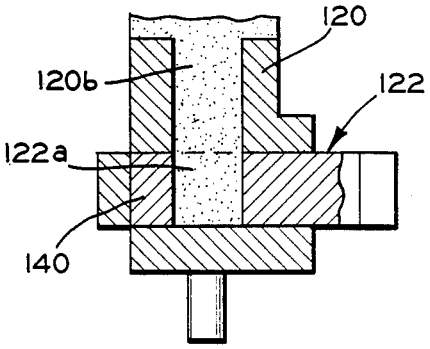

Referring now to FIGS. 6*g*, 6*h* and 6*j*, the product metering apparatus 122 generally includes a relatively stationary member 140 having a number of slots 140*a* (see FIG. 6*j*) which cooperate with a corresponding number of fingers 142*a* projecting from a plate member 142 for defining metering chambers 122*a* (see FIGS. 6*c* and 6*g*). The plate member 142 is movable towards and away from the plate member 140 and controls the size of the chamber 122*a*. Means such as a traveling nut plate 142*b* fixed to the plate 142 is movable by spaced screw members 144 rotatably journalled in a known manner to a plate 140*b* affixed to the member 140. Rotation of the screw members 144 in one direction moves the fingers 142*a* into the slots 140*a* to reduce the size of the chambers 122*a* while rotation of the screw members in the opposite direction withdraws the fingers from the slots 140*a* and increases the size of the chambers 122*a*. After the product has been dispensed, the carriage 12 is driven to transport the packet assembly from the product dispensing station 26 to the corner sealing station 28.

Figure 7A:
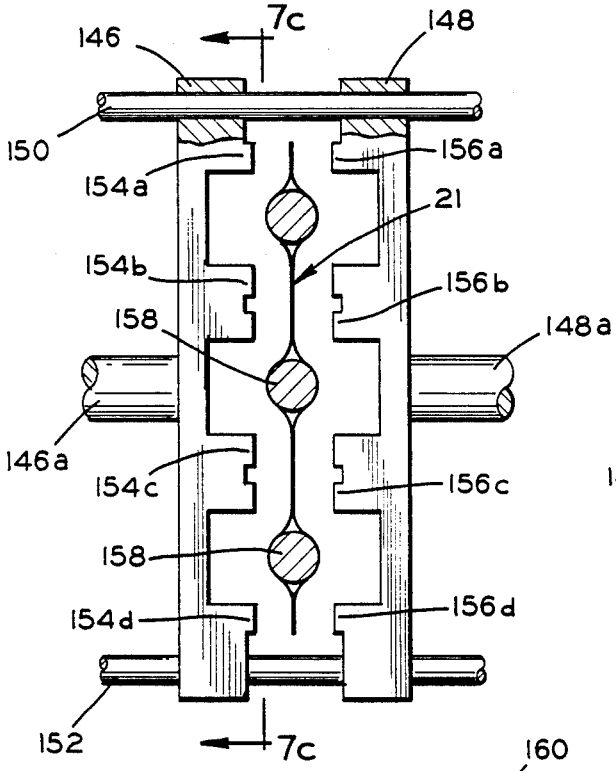
FIGS. 7*a* and 7*b* illustrate the operation of the corner sealing station of FIG. 1 utilized to produce the packet assembly as shown in FIG. 2*c*.
Figure 7B:
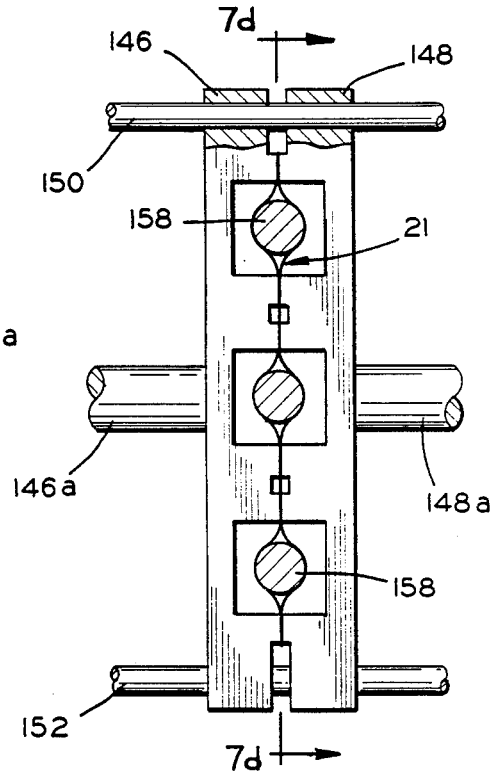
Figure 7C:
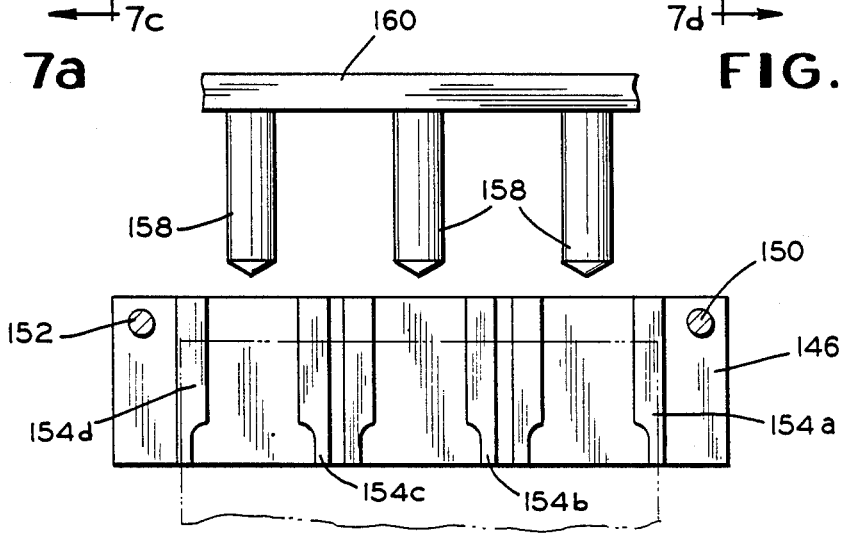
FIG. 7*c* is a sectional view taken along the line 7*c*—7*c* of FIG. 7*a* and illustrating, in its upper position, a mechanism for sizing the opening of the packet and the surface of one of the corner sealing members which faces the packet assembly.
Figure 7D:
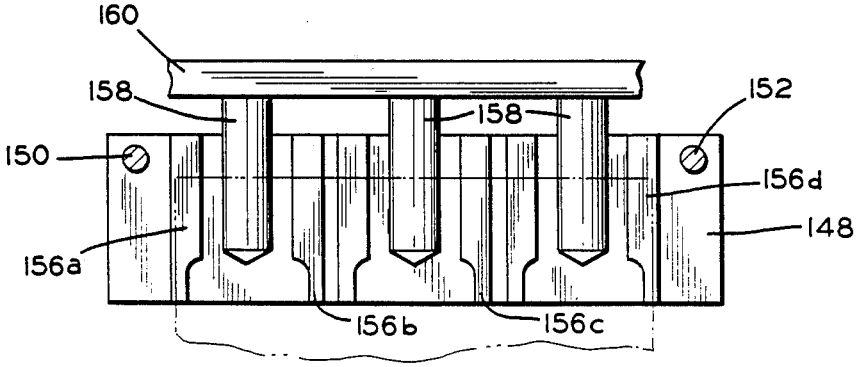
FIG. 7*d* is a sectional view taken along line 7*d*—7*d* in FIG. 7*b* and illustrating the sizing mechanism in an operating position and the surface of the corresponding corner sealing member which faces the opposite side of the packet assembly.

The components of the corner sealing station 28 are shown in more detail in FIGS. 7*a* through 7*d*. As shown in FIG. 7*a*, the corner sealing operation is performed by utilizing a pair of spaced apart support plates 146 and 148 slidably mounted on a pair of spaced apart horizontal guide shafts 150 and 152. The support plates 146 and 148 are coupled to a suitable drive mechanism (not shown) of the machine by arms 146*a* and 148*a*. As shown in FIGS. 7*c* and 7*d*, a plurality of heated sealing pressure pads 154*a* through 154*d* are mounted on the face of the support plate 146 and cooperate with similar heated sealing pads 156*a* through 156*d* on the opposite support plate 148 for effecting the desired corner sealing of the packets as shown in FIG. 2*c*. Once the packet assembly 21 has been positioned by the carriage 12 between the plates 146 and 148 as shown in FIG. 7*a*, the sealing elements can be moved toward one another, as shown in FIG. 7*b*, to effect the desired corner sealing.

Also, the corner sealing station 28 includes means for sizing the opening in the top of each packet 22. To this end, a number of sizing rods 158 corresponding to the number of packets being processed are mounted on a plate 160 movable by means (not shown) into and out of the packets as illustrated in FIGS. 7*c* and 7*d*, respectively.

Figure 8A:
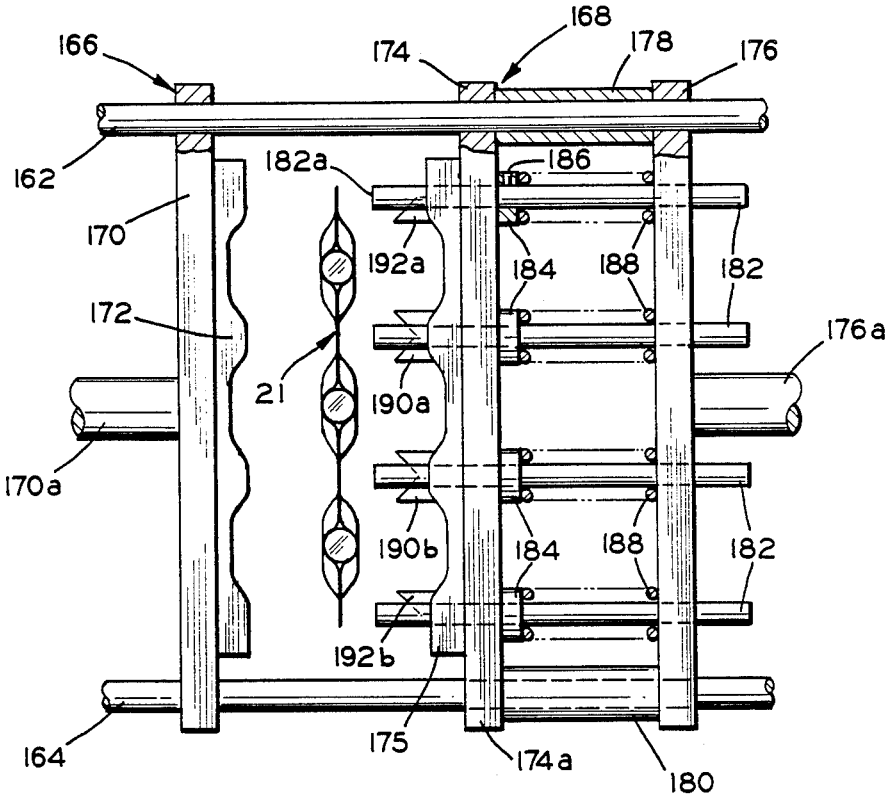
FIGS. 8*a*, 8*b* and 8*c* illustrate the operations of the horizontal cutting station of FIG. 1 in producing horizontal slits in the packet assembly as shown in FIG. 2*d*.
Figure 8B:
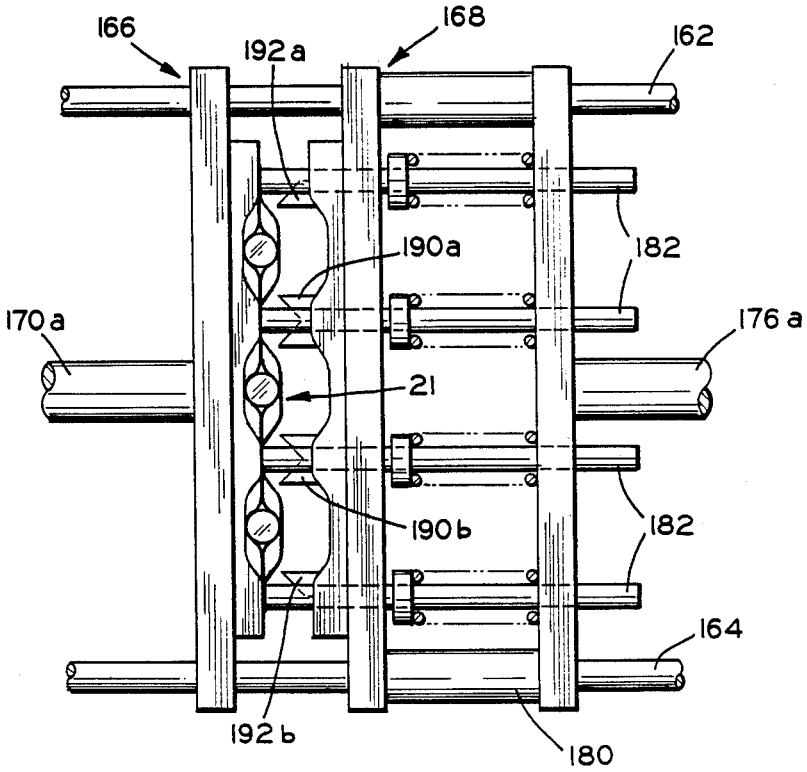
Figure 8C:
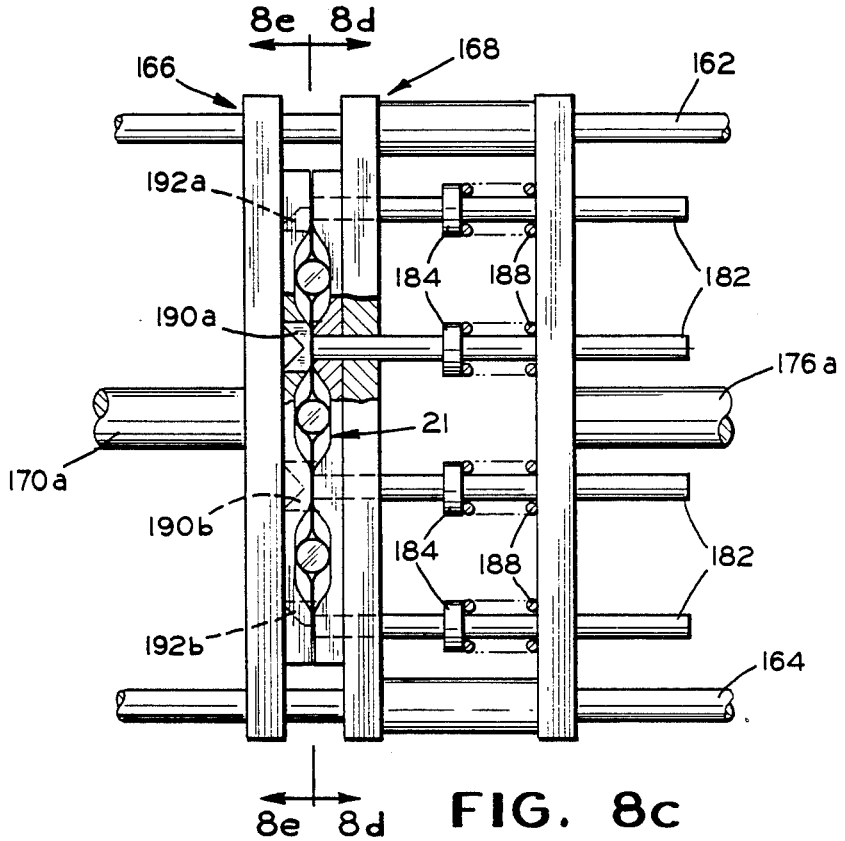

After the upper corners of each individual packet have been sealed, the packet assembly is transferred to the horizontal cutting station 32 wherein the slit portions 34*a* and 34*b* shown in FIG. 2*d* are formed. The components of the side cutting station 32 are shown in more detail in FIGS. 8*a* through 8*e*. As shown in FIG. 8*a*, the cutting assembly includes a pair of spaced apart horizontal guide shafts 162 and 164 for slidably supporting a cutting plate assembly 166 and a cooperating cutting mechanism 168 for movement toward and away from a packet assembly 21 positioned therebetween. The cutting plate assembly 166 includes a mounting plate 170 having apertures formed in the ends thereof for slidably receiving the guide shafts 162 and 164. One face of the mounting plate 170 is secured to an arm member 170*a* adapted to be connected to a suitable drive mechanism (not shown) for controlling the position of the cutting plate assembly along the guide shafts 164 and 166. The opposite face of the mounting plate 170 is provided with a cutting block 172 having a plurality of grooves 172*a* (shown in FIG. 8*e*) formed therein which, as will be discussed, are utilized to receive portions of the cutting blades of the cooperating cutting mechanism 168 when the two assemblies are moved toward one another.

The cutting mechanism 168 includes a pair of spaced apart mounting plates 174 and 176 which are secured together by means of a pair of spaced apart sleeve members 178 and 180. The mounting plate 176 is secured to an arm 176*a* adapted to be connected to a drive mechanism (not shown) for controlling the position of the cutting mechanism along the guide shafts 164 and 166. A plurality of spaced apart holding pins 182 extend through apertures formed in the plates 174 and 176 and have outer end portions 182*a* which, as will be discussed, are utilized to securely hold the upper portions of the packets against the cutting block 172 of the cutting plate assembly 166 during the cutting operation. A separate retaining ring 184 is adjustably secured by set screws 186 to each holding pin at a predetermined distance from the one end 182*a*. A helical compression spring 188 is mounted about each holding pin and has one end which engages the spring retaining ring 184 and an opposite end which engages a surface of the plate 176.

Figure 8D:
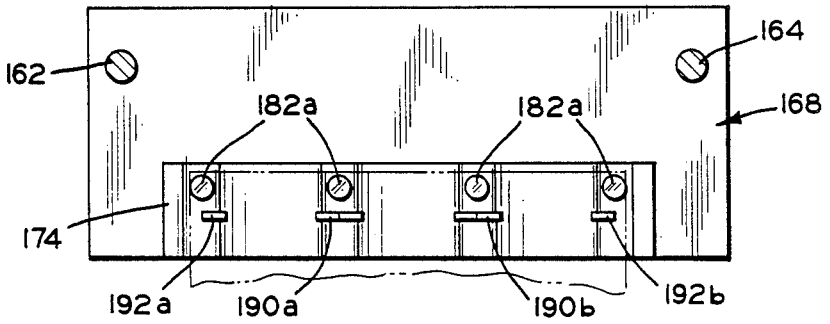
FIG. 8*d* is a sectional view taken along line 8*d*—8*d* in FIG. 8*c* and illustrating the side of one of the cutting assemblies which faces the packet assembly.
Figure 8E:
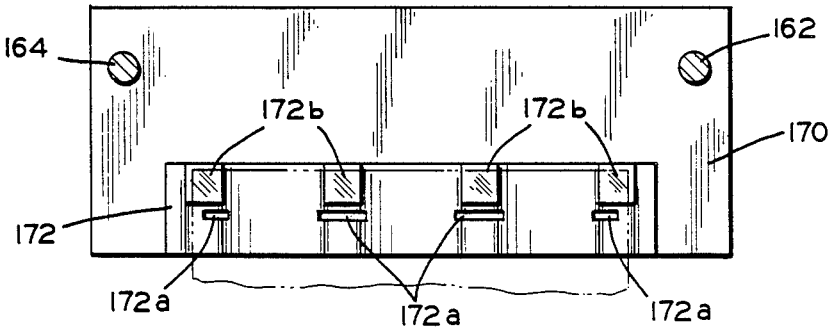
FIG. 8*e* is a sectional view taken along line 8*e*—8*e* in FIG. 8*c* and illustrating the side of the other one of the cutting assemblies which faces the packet assembly.

As shown in FIGS. 8*a* and 8*d*, one surface 174*a* of the mounting plate 174 supports a cutting blade mounting block 175 which includes an intermediate pair of horizontal V-shaped cutting blades 190*a* and 190*b* and a pair of horizontal outer spaced cutting blades 192*a* and 192*b*.

Initially, the components of the cutting station 32 are in a position as shown in FIG. 8*a*. When a packet assembly has been positioned as shown in FIG. 8*a* between the cutting plate assembly 166 and the cutting mechanism 168 by the carriage 12, the cutting assembly 166 and the cutting mechanism 168 are moved toward one another to the position shown in FIG. 8*b*, wherein the outer end portions 182*a* of the holding pins 182 contact the upper portions of the packet assembly to hold the packets securely against the cutting block 172. More specifically, a plurality of holding pins 182 securely hold the upper side portions of each packet against cooperating rubber pads 172*b* fixedly mounted on the cutting block 172 (see FIG. 8*e*).

After the two assemblies are in the position as shown in FIG. 8*b*, the cutting plate assembly 166 will maintain its position on the guide shafts while the cutting mechanism 168 will continue to be moved toward the cutting plate assembly 166 until the cutting blades have pierced the packaging material and have been received by the grooves 172*a* in the cutting block 172. As the cutting mechanism 168 is moved further toward the cutting plate 172, the holding pin 182 will remain stationary, causing the retaining rings 184 to compress the helical springs 188 and increase the holding force of the pins. After the upper corners of the packets have been slit, the two assemblies 166 and 168 are retracted and the packet assembly will be of the form as illustrated in FIG. 2*d*.

Figure 9A:
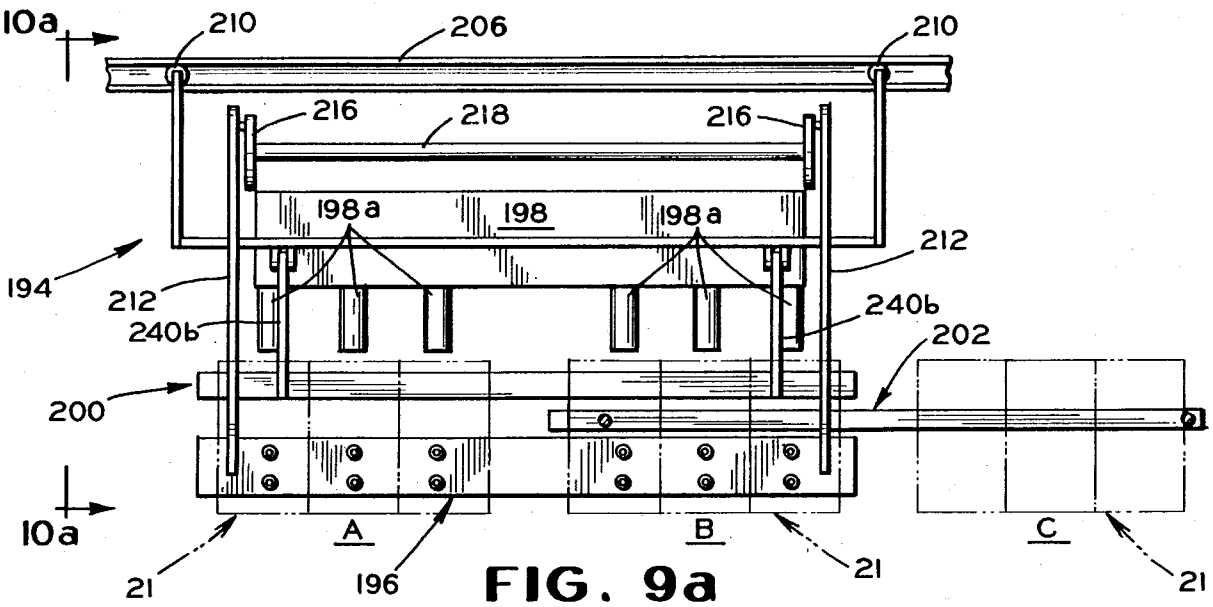
FIGS. 9*a* and 9*b* are elevational views illustrating the cycling of the vacuum and initial stretching and top sealing station of FIG. 1 in producing the packet assemblies as illustrated in FIG. 2*e*.
Figure 9B:
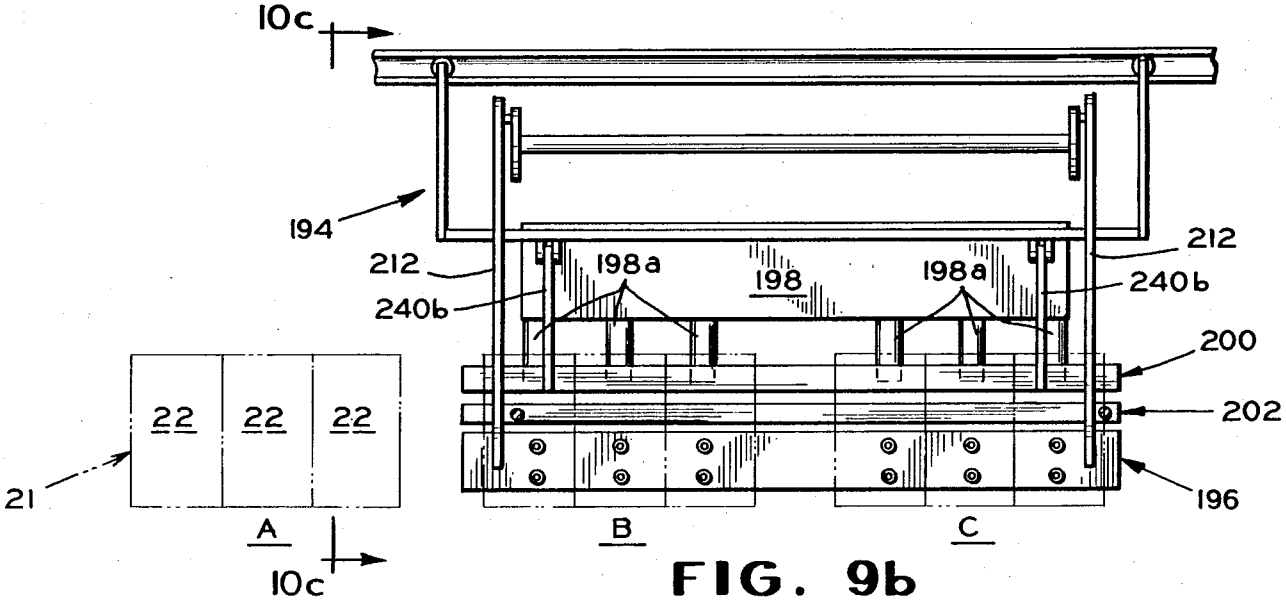

Next, the carriage 12 transports the packet assemblies 21 to the vacuum and initial top stretching and sealing station 36. The vacuum and initial top stretching and sealing station is schematically shown in FIGS. 9*a* and 9*b* and in more detail in FIGS. 10*a* through 10*d*, 11, 12*a* through 12*e*, and 13*a* through 13*d*. As a result of the time requirements to perform the vacuum and initial top stretching and sealing operation, this operation is adapted to be performed over two machine cycles, whereas each of the previously discussed operations are performed during a single machine cycle. Thus, in order to obtain maximum production from the machine, it is necessary that the vacuum station 36 simultaneously operate on twice the number of packets operated on by each of the other stations. Also, it is necessary that certain components of the vacuum station be moveable with the carriage 12 as the packet assemblies are indexed forwardly.

Referring now to FIGS. 9*a* and 9*b*, the components of the vacuum and initial top sealing station 36 generally include a moveable vacuum producing section transported by a carriage 194 from a packet pick-up position to a packet sealing position in synchronism with the carriage 12 transporting the packet assemblies 21. Generally, the movable vacuum section comprises an overhead carriage 194 and includes a clamp device 196 for compressing, shaping, and securely clamping each individual packet 22 of the packet assembly 21 to the carriage 12, a vacuum means 198 coupled to a vacuum source (not shown) including a plurality of downwardly extending vacuum tubes 198*a* insertable into the interior of each packet 22 for placing the interior of the packet under vacuum pressure, and means 200 for temporarily sealing the top of the packet about the vacuum tube. 198*a*. As illustrated in FIGS. 9*a* and 9*b*, the movable vacuum section is adapted to operate on two separate packet assemblies as the section is moved from the position shown in FIG. 9*a* to the position shown in FIG. 9*b*.

Figure 10A:
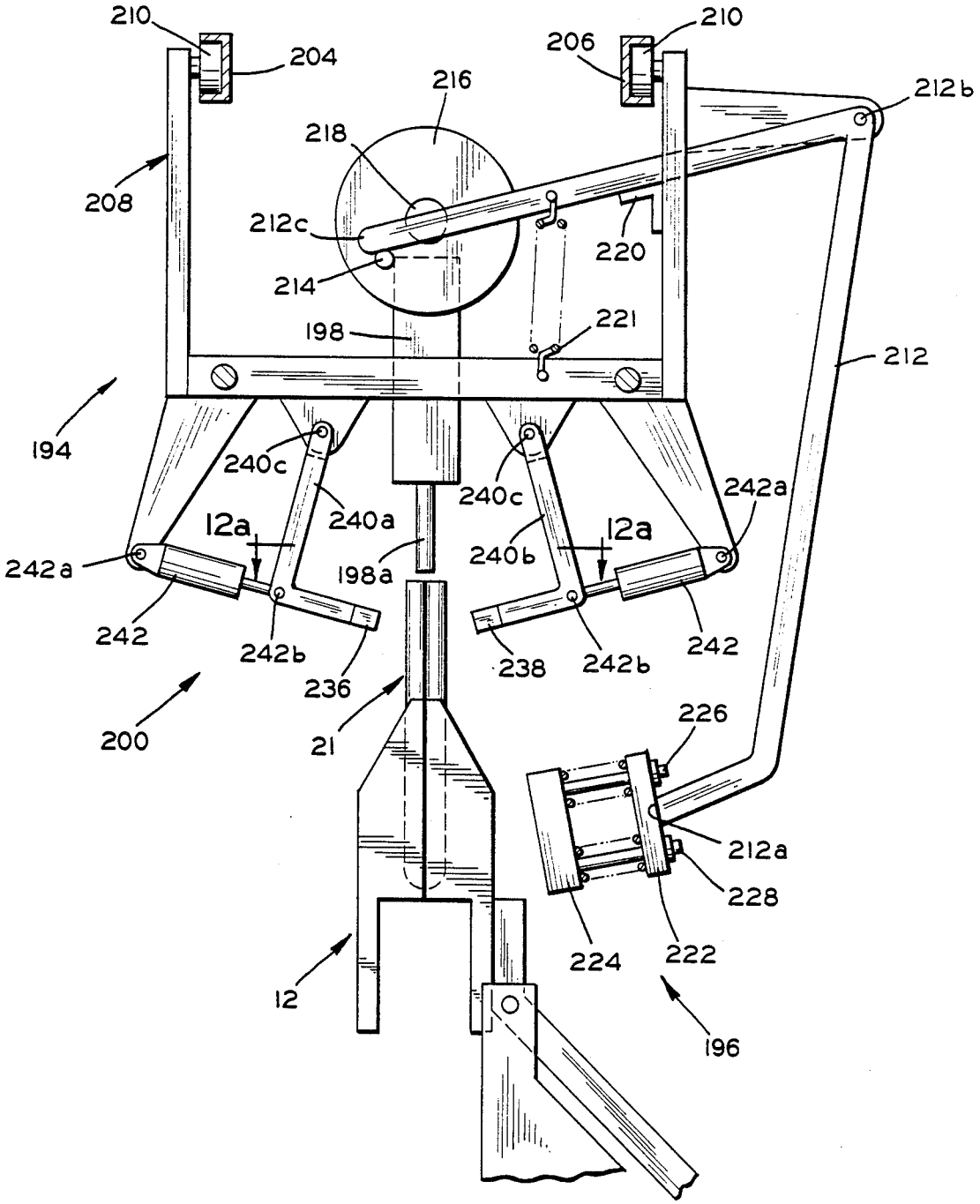
FIGS. 10*a* through 10*d* are elevational views which illustrate, in sequence, the operations of the vacuum and initial stretching and top sealing station as illustrated in FIG. 9*a* and 9*b* and utilized in producing the packet assemblies as shown in FIG. 2*e*.
Figure 10B:
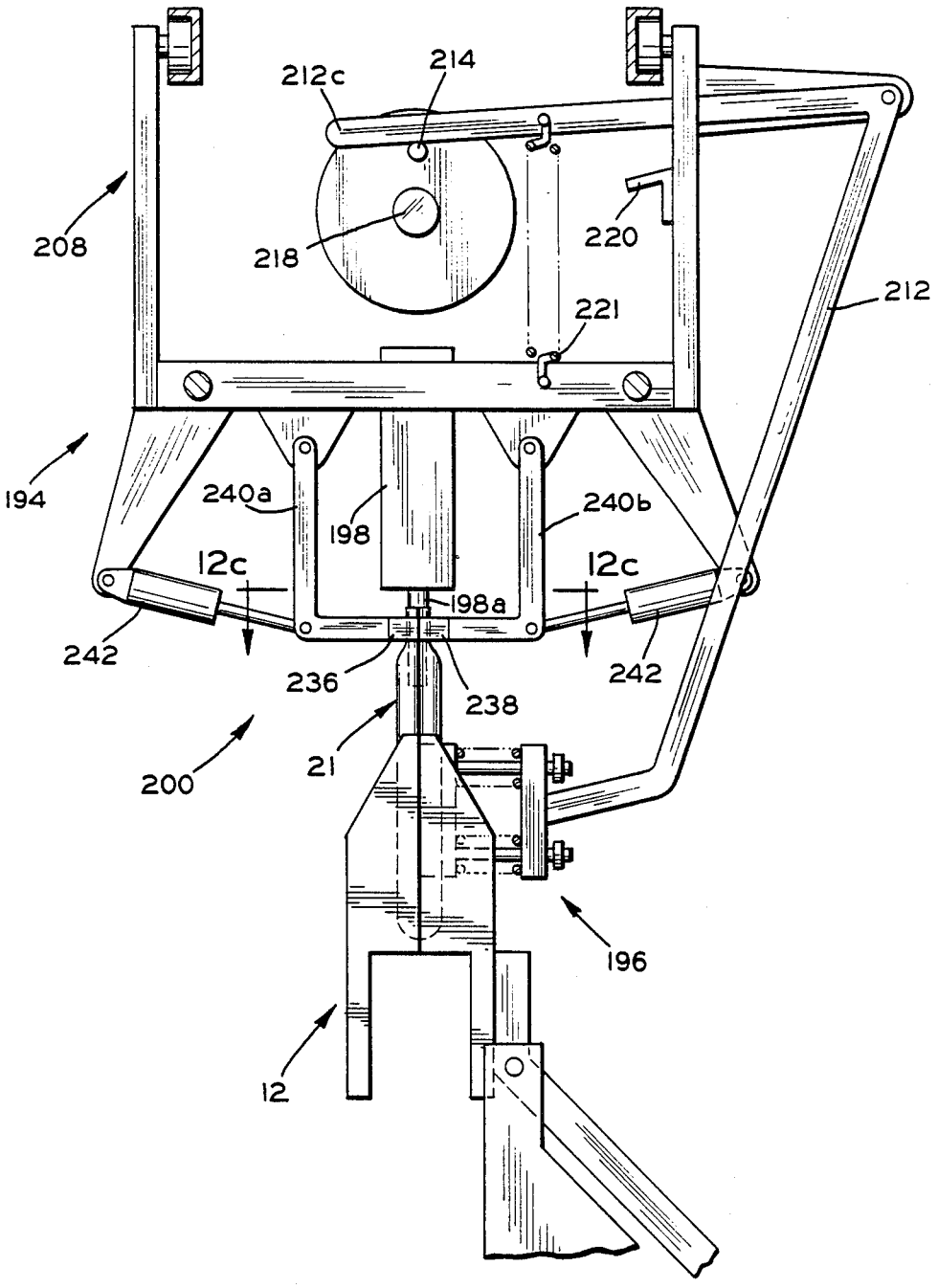

FIGS. 10*a* and 10*b* illustrate movements of the components of the clamp device 196, the vacuum means 198 and the temporary sealing means 200. As shown in FIG. 10*a*, the carriage 194 is reciprocally moved between the first and second positions along a pair of overhead guide rails 204 and 206. A U-shaped carriage frame 208 is suspended from the guide rails 204 and 206 by rollers 210 and is moveable in either longitudinal direction by means (not shown) in synchronism with the carriage 12.

As shown in FIG. 10*a*, the clamp device 196, mounted at one end 212*a* of an angle shaped arm 212, is pivotally mounted at 212*b* to the frame 208. The other end 212*c* of the arm 212 cooperates with a crank roller pin 214 projecting from a disc 216 mounted for rotation with a shaft 218 coupled to a suitable drive means (not shown). An abutment 220 fixed to the frame 208 and a tension spring 221 extending between the end 212*c* of the arm and the frame prevents the clamp device from swinging freely in either direction of movement.

Figure 11:
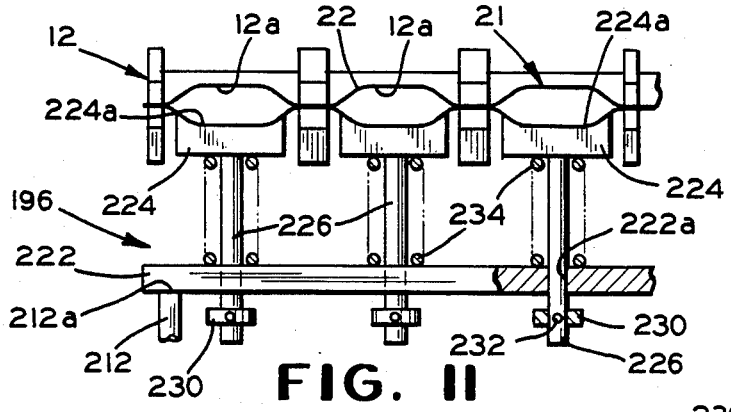
FIG. 11, taken along line 11—11 in FIG. 10*c*, is a top plan view of the clamp mechanism employed to compress, shape, and securely hold the packet assembly in the carriage during the vacuum operation.

Referring now to FIG. 11, the clamp device 196 includes a mounting plate 222 mounted for movement on the ends 212*a* of a pair of the longitudinally spaced arms 212 (see FIGS. 9*a* and 9*b*). A number of clamping members 224 have clamping surfaces 224*a* which are configured to initially compress and shape the filled packets 22 in a desired manner and are individually movably mounted on the mounting plate 222 by vertically spaced pairs of holding pins 226 and 228 (see FIG. 10*a*) extending through apertures 222*a*. A holding pin ring 230 is secured to each holding pin 226 and 228 by a roll pin 232 adjacent the rear face 222*b* of the plate 222. A compression spring 234 is mounted about each pain of holding pins 226 and 228 and has one end which engages the clamping members 224 and an opposite end which engages the front face 222*c* of the plate 222. The compression springs 234 increases the holding force applied by the clamp members 224 to hold the packets 22. As shown in FIG. 11, the surfaces 12*a* of the carriage 12 against which the package is clamped is similar in configuration to the clamping surface 224*a*. The vacuum means 198 including the tubes 198*a* each positioned above a separate packet 22 is vertically moveable in both directions to extend into and be withdrawn from the interior of the packet by suitable drive means (not shown).

The initial stretching and vacuum sealing operation is performed by utilizing a pair of support plates 236 and 238 pivotally mounted on longitudinally spaced pairs of L-shaped arms 240*a* and 240*b*, respectively, (see FIGS. 9*a* and 9*b*). As illustrated in FIG. 10*a*, each arm 240*a* and 240*b* is swingable about a pivotal connection 240*c* on the frame 208 by a fluid power cylinder 242 having the cylinder end 242*a* pivotally connected to the carriage frame 208 and the piston end 242*b* pivotally connected to an intermediate portion of the L-shaped arms 240*a* and 240*b*. Thus, the plates 236 and 238 are swingable toward and away from each other to clamp and unclamp an upper intermediate portion the packets 22 therebetween. Referring now to FIGS. 12*a* through 12*e*, a number of sealing pressure pad 244*a* through 244*c* formed of a soft flexible. material are mounted on the face 236*a* of the plate member 236 and cooperate with similar sealing pressure pads 246*a* through 246*c* mounted on the face 238*a* of the opposite plate member 238 for effecting the sealing of each open packet around the respective vacuum tube 198*a* projecting into the interior of the packet.

Figures 12A, 12B, 12C:
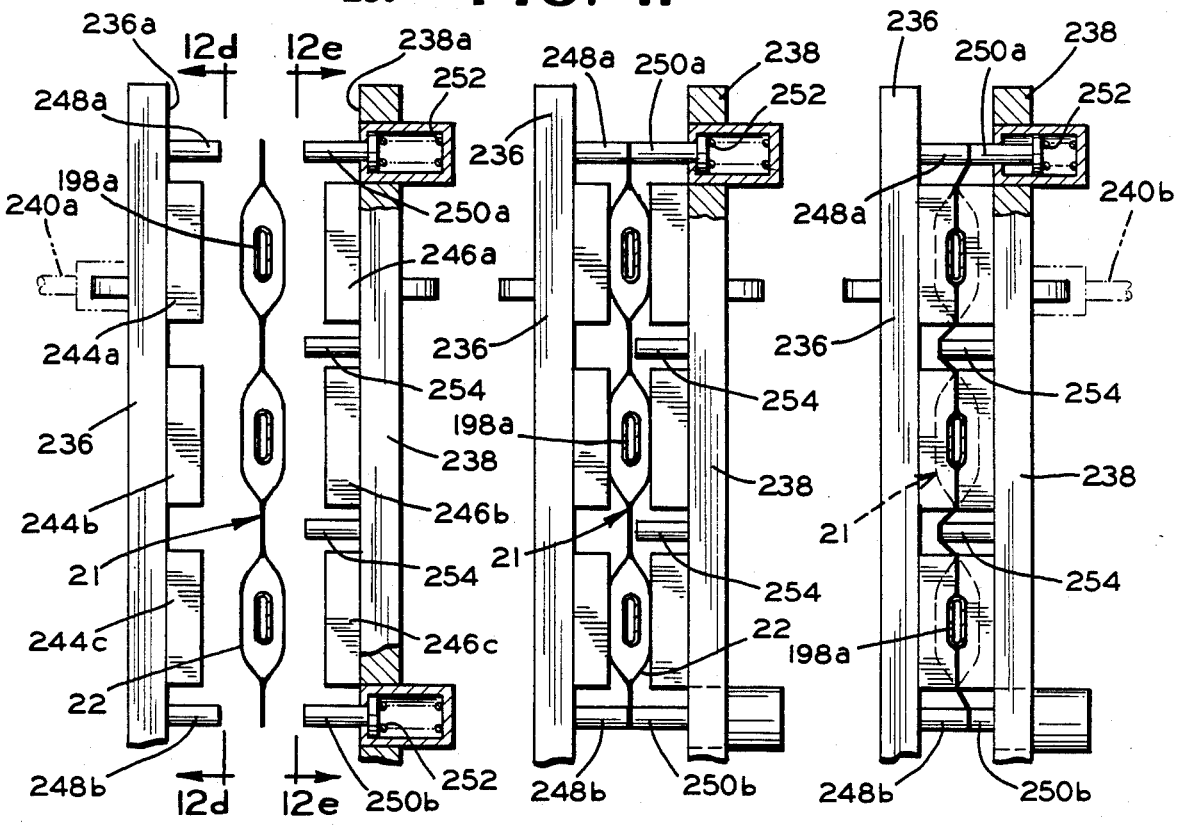
FIGS. 12*a* through 12*e* illustrate the sequence of operations performed by the top stretching and vacuum sealing means employed in producing the packets illustrated in FIG. 2*e*.
Figure 12D:
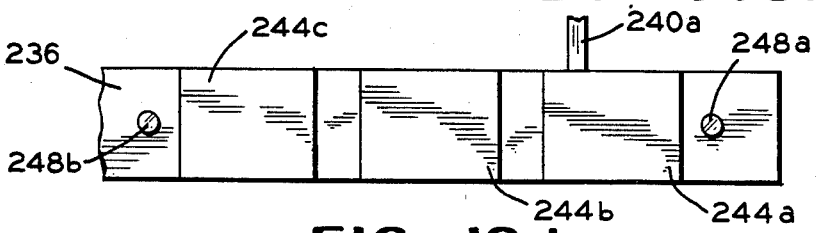
Figure 12E:
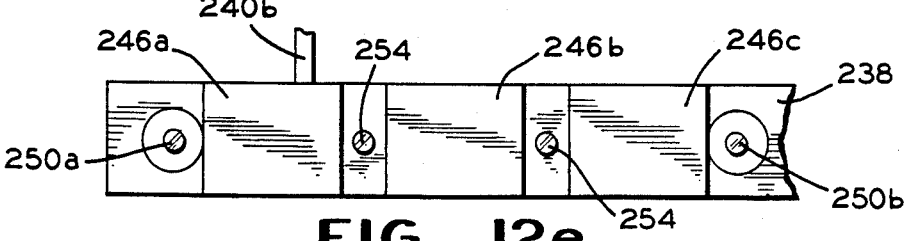

Also, as illustrated in FIGS. 12*a* through 12*e*, a pair of clamping pins 248*a* and 248*b* are mounted on the face 236*a* of the plate member 236 longitudinally outwardly of the sealing pads 244*a* through 244*c* and cooperate with similar clamping pins 250*a* and 250*b*, respectively, mounted on the face 238*a* of the plate member 238. The clamping pins 250*a* and 250*b* are biased in one direction by compression springs 252 to move in and out relative to the face 238*a* of the plate 238. An intermediate pin 254 is mounted on the face 238*a* between the pads 246*a* and 246*b* and also between the pads 246*b* and 246*c*. It will be noted, as illustrated in FIG. 12*b*, that the cooperating clamping pins 248 and 250 contact and clamp the outer edges of the packet assembly 21 prior to engagement of the intermediate pins 254 with the packet assembly 21. Once a packet assembly has been positioned between the plate members 236 and 238 as shown in FIG. 12*a*, the plate members are moved toward one another as shown in FIGS. 12*b* and 12*c*, to effect the desired stretching and vacuum sealing of the packets about the vacuum tube members 198*a*.

Figure 10C:
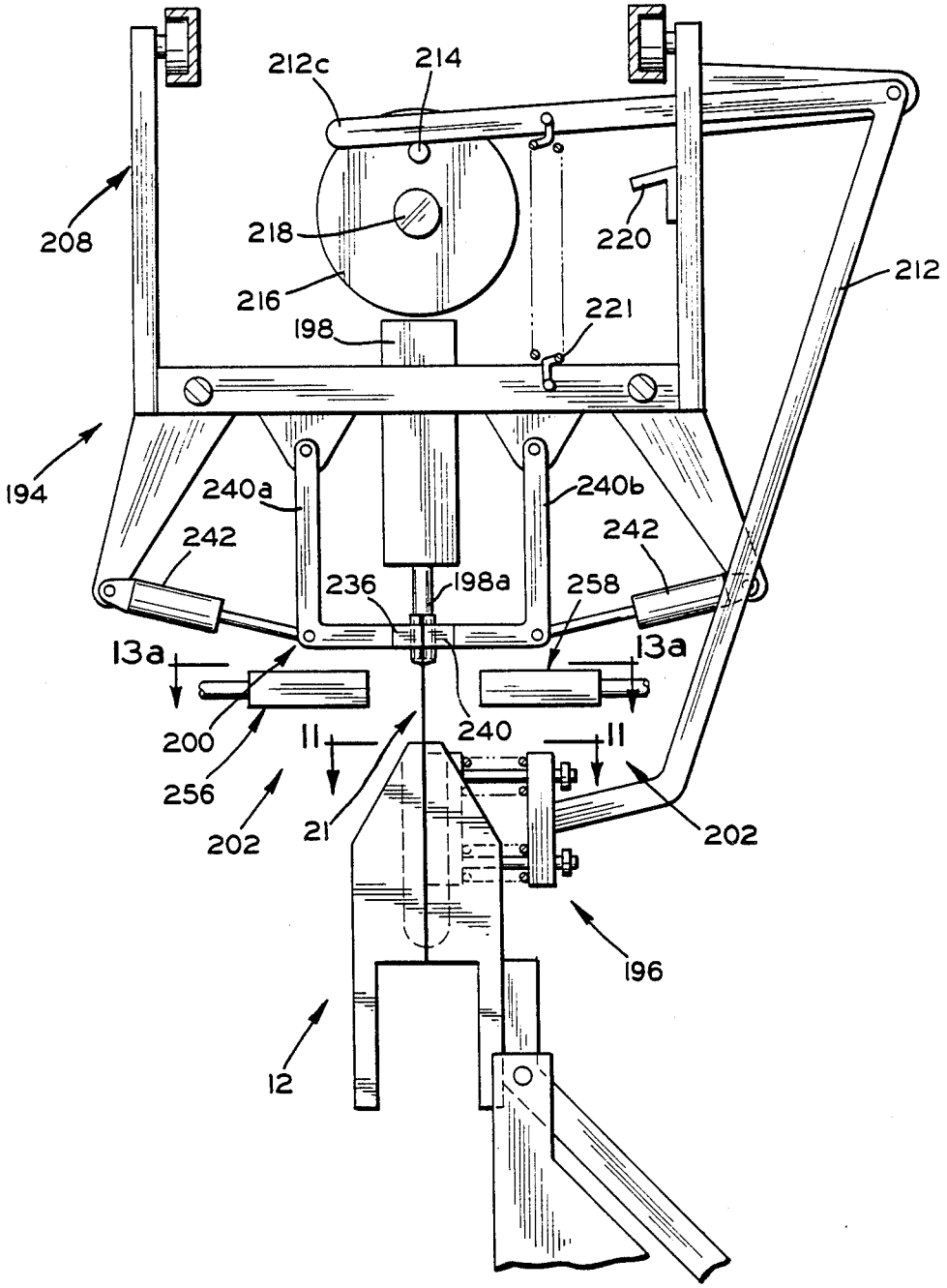
Figure 10D:
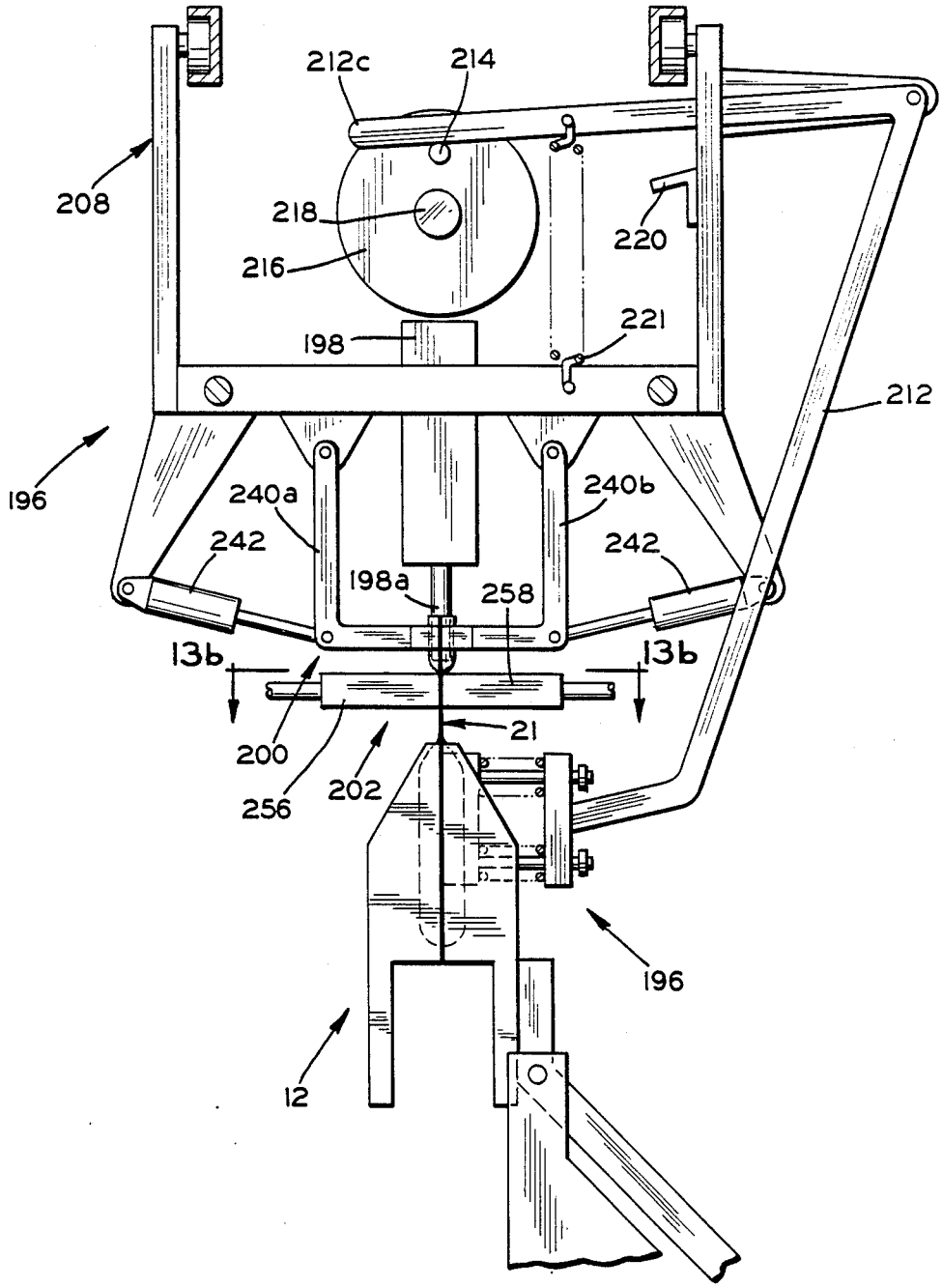

Referring now to FIGS. 9*a* and 10*a*, when two packet assemblies 21 have been transported beneath the vacuum means 198 and between the clamping devices 196 and the initial stretching and vacuum sealing means 200 (at positions A and B as shown in FIG. 9*a*), the clamping devices 196 are actuated to clamp the packet assemblies to the carriage 12 for synchronizing the movement of the carriage 12 with the movement of the overhead carriage 194. Simultaneously, with the clamping operation, the vacuum means 198 is lowered so that the vacuum tube 198*a* enters the packets 22 and the vacuum sealing pads 244*a* through 244*c* and 246*a* through 246*c* move into engagement with the side portions of the packet assembly 21, as illustrated in FIG. 10*b*, to temporarily seal the open top of each packet about the respective vacuum tubes. At this time, the vacuum means can be actuated to evacuate the packets, as shown in FIG. 10*c*. As the carriage 194 transports the packets from the first position (at A and B) shown in FIG. 9*a* to the second position (at B and C) shown in FIG. 9*b*, the vacuum tubes 198*a* are partially retracted (as shown in FIG. 10*c*) while the vacuum sealing means remain fully engaged as illustrated in FIG. 12*c*.

Figure 13A:
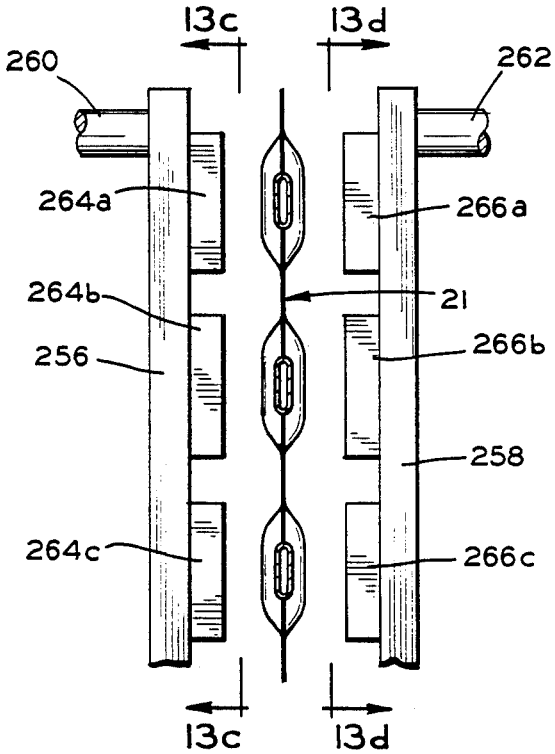
FIGS. 13*a* through 13*d* illustrate the sequence of operations performed by the initial top heat sealing means used in producing the packets illustrated in FIG. 2*e*.
Figure 13B:
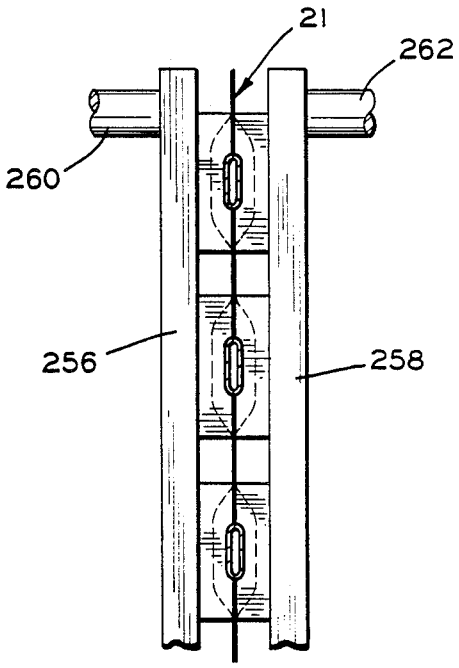
Figure 13C:
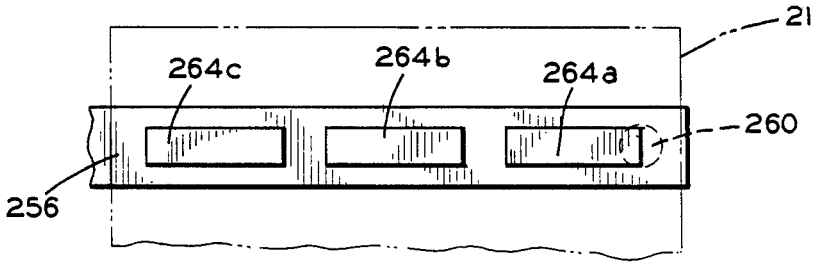
Figure 13D:
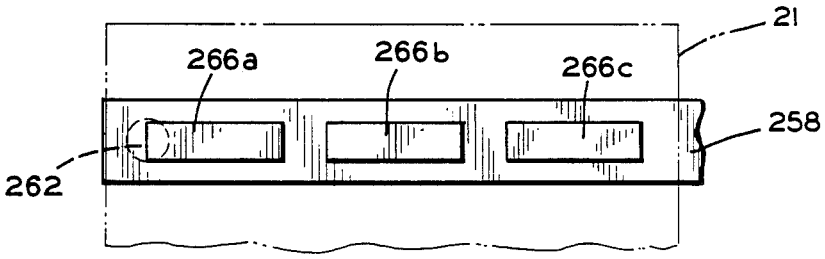

Referring now to FIGS. 9*b* and 10*c*, the packet assemblies 21 are positioned between the heat sealing means 202. The components of the heat sealing means 202 is shown in more detail in FIGS. 13*a* through 13*d*. As shown in FIG. 13*a*, the intermediate heat sealing operation is performed by utilizing a pair of spaced apart support plates 256 and 258 slidably mounted on pairs of spaced apart horizontal guide rails 260 and 262 (only one shown for each plate). The support plates are coupled to a suitable drive mechanism (not shown) for movement towards and away from one another. As shown in FIGS. 13*a* through 13*d*, a plurality of heat sealing pressure pads 264*a* through 264*c* are mounted on the face 256*a* of the support plate 256 and cooperate with similar heat sealing pads 266*a* through 266*c* mounted on the opposite support plate 258 for effecting the first or initial top sealing of the packets as shown in FIG. 2*e*. Once the packet assembly has been positioned between the plates as shown in FIG. 13*a*, the sealing elements can be moved toward one another as shown in FIG. 13*b*, to effect the desired intermediate top sealing of the packets. After the initial top sealing operation is completed, the vacuum tubes 198*a* are retracted and the clamping devices 196 are released such that the carriage 194 can return to the first position to begin another operation. As the carriage 194 returns to the first position shown in FIG. 9*d*, the carriage 12 is indexed forwardly such that the moveable vacuum section will be in position to operate on two new packet assemblies.

Figure 14A:
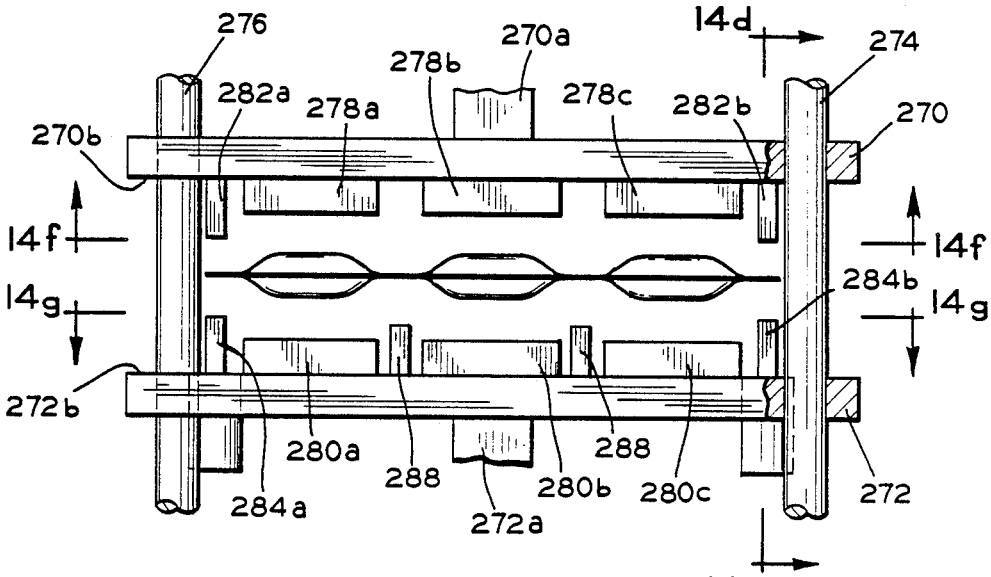
FIGS. 14*a* through 14*g* illustrate the sequence of operations performed by the final top stretching and sealing station of FIG. 1 in producing the packet assemblies as illustrated in FIGS. 2*f* and 2*g*.
Figure 14B:
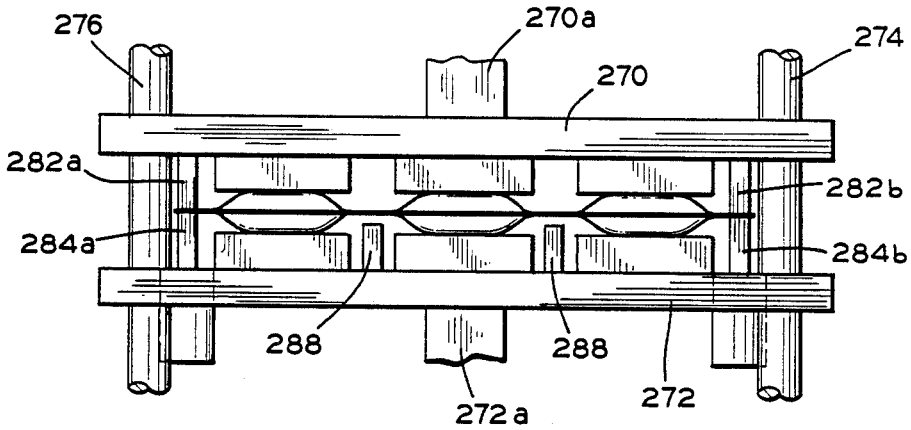
Figure 14C:
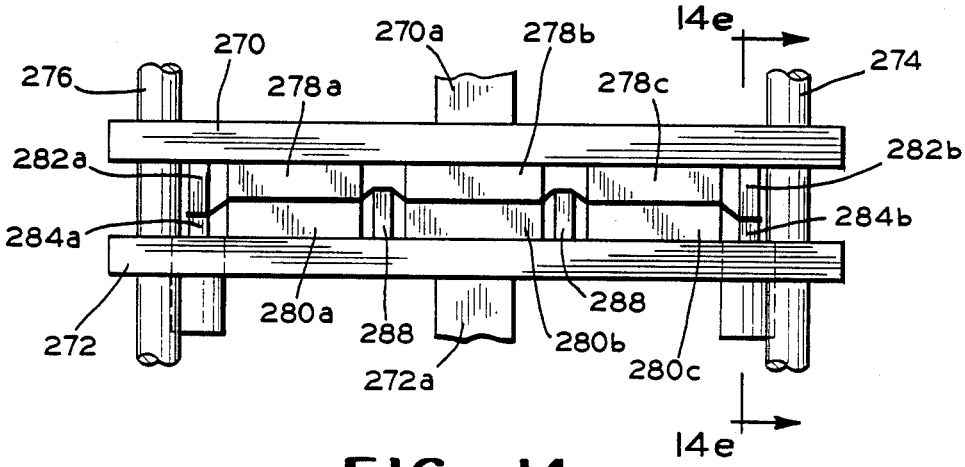
Figure 14D:
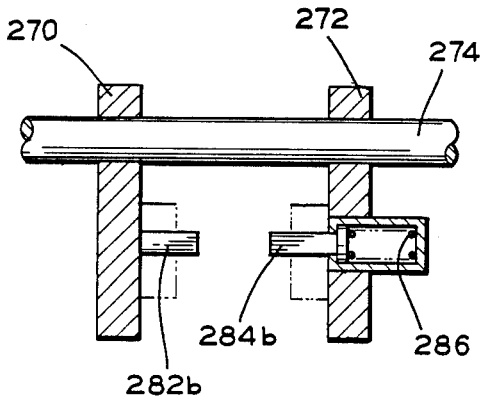
Figure 14E:
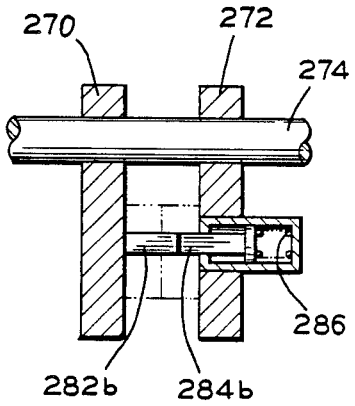
Figure 14F:
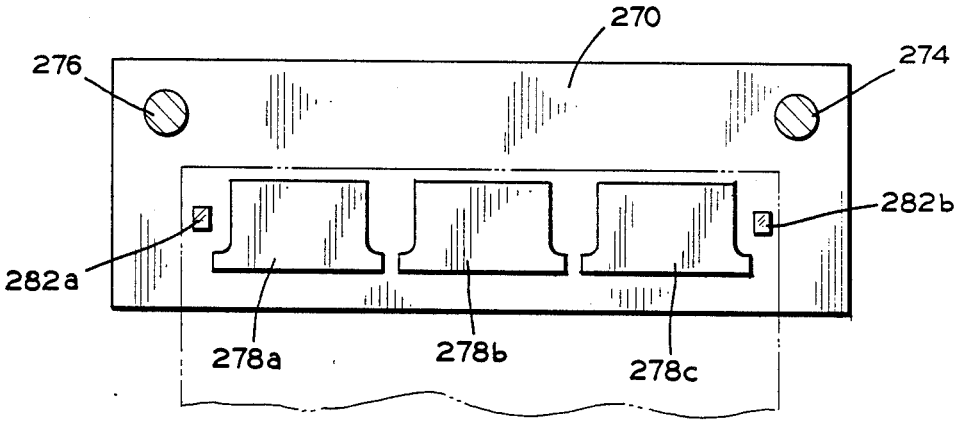
Figure 14G:
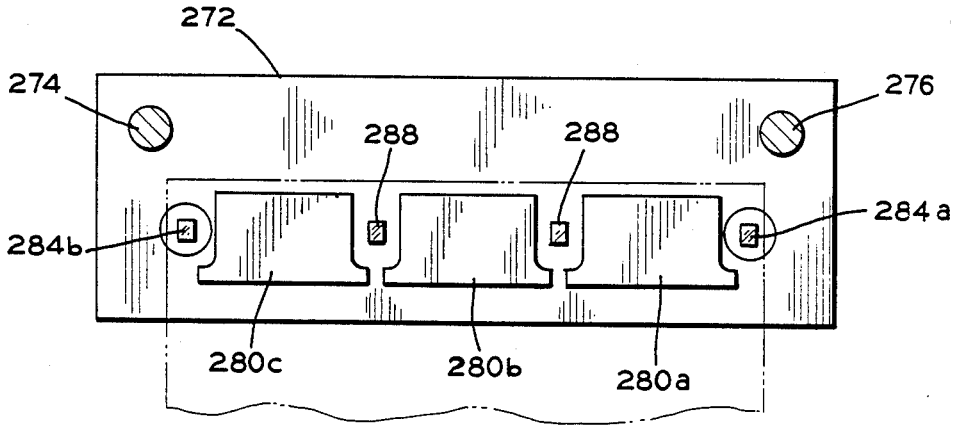

After the initial top sealing operation is performed, the carriage 12 transports one of the two packet assemblies which has just been operated on by the vacuum station 36 to the final top stretching and sealing station 37. The other one of the two packet assemblies remains in position C, as shown in FIG. 9*a*, until the next machine cycle, at which time it is indexed forwardly to the final sealing station 37. The final top stretching and sealing station 37 is shown in more detail in FIGS. 14*a* through 14*g*. Referring now to FIG. 14*a*, the final stretching and sealing operation is performed by utilizing a pair of spaced apart support plates 270 and 272 slidably mounted on a pair of spaced apart horizontal guide shafts 274 and 276. The support plates 270 and 272 are coupled to a suitable drive mechanism (not shown) by arms 270*a* and 272*a*, respectively. As illustrated in FIGS. 14*a* through 14*g*, a plurality of heat sealing pressure pads 278*a* through 278*c* are mounted on the face 270*b* of the support plate 270 and cooperate with similar heat sealing pressure pads 280*a* through 280*c* mounted on the facing surface 272*b* of the opposite support plate 272 for effecting the desired final top sealing of the packets as shown in FIG. 2*f*. Once the packet assembly 21 has been positioned between the plates as shown in FIG. 14*a*, the sealing elements can be moved toward one another as shown in FIG. 14*c*, to effect the final top sealing of the packets.

Also, as illustrated in FIGS. 14*a* through 14*g*, a pair of clamping pins 282*a* and 282*b* are mounted on the face 270*b* of the support member 270 longitudinally outwardly of the pressure sealing pads 278 and cooperate with similar clamping pins 284*a* and 284*b* mounted on the face 272*b* of the plate member 272. The clamping pins 284*a* and 284*b* are biased in one direction by compression springs 286 (see FIGS. 14*d* and 14*e*) to securely clamp the ends of the packet between the ends of the opposed clamping pins. Intermediate stretching pins 288 are mounted on the face 272*b* between the sealing pads 280*a* and 280*b* and between the pads 280*b* and 280*c*, to effect the desired horizontal top stretching of the packets as illustrated in FIG. 14*c*.

Figure 15A:
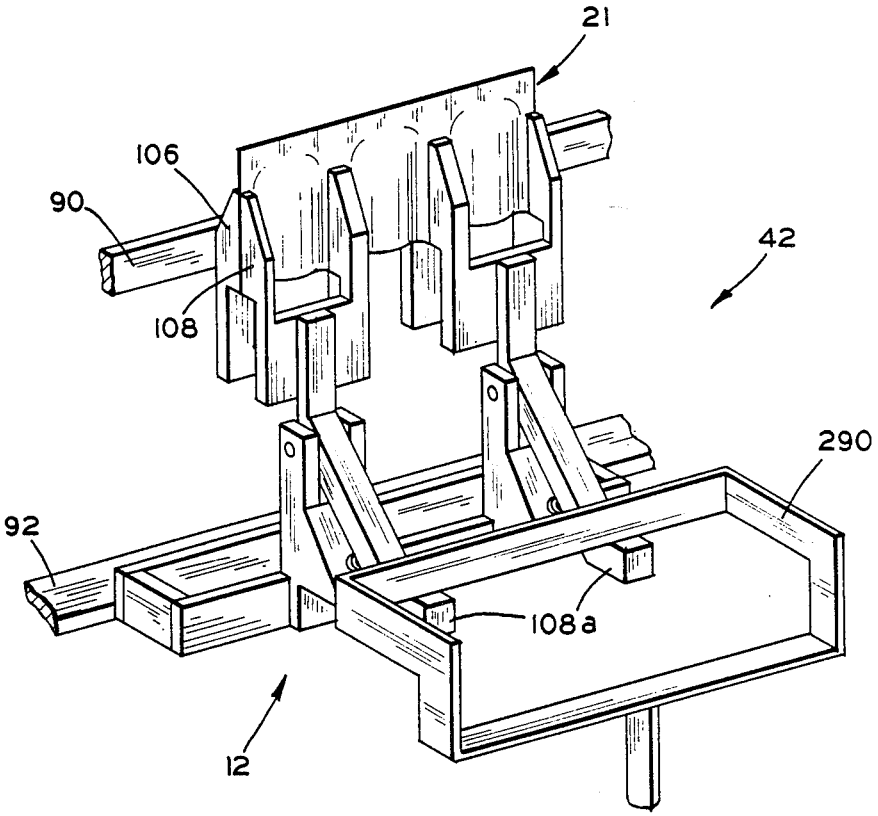
FIG. 15*a* is a perspective view illustrating the release station FIG. 1.
Figure 15B:
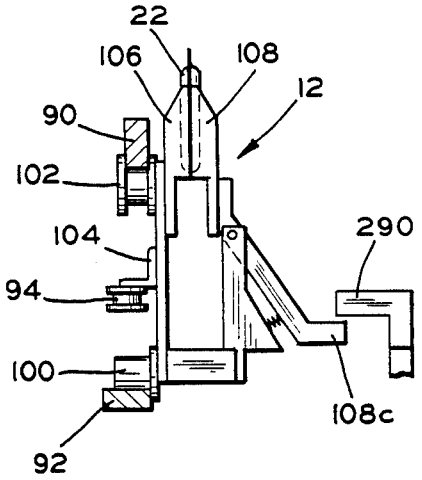
FIGS. 15*b* and 15*c* illustrate the release operation performed by the mechanism of FIG. 15*a*.
Figure 15C:
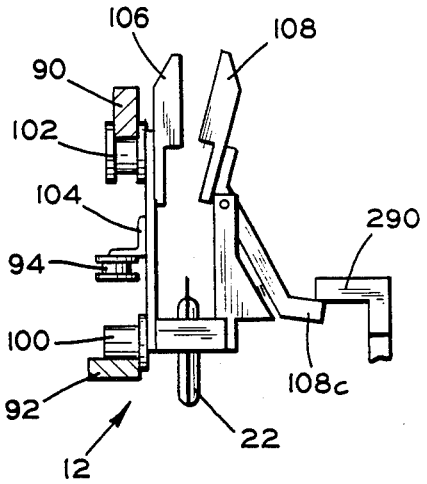

Once the top sealing operation has been completed, the packets are transported by the carriage 12 to the separation and release station 42 which is illustrated in FIGS. 15*a* through 15*d*. The station 42 includes a release bar 290 coupled to a suitable actuating mechanism (not shown) and adapted to engage and pivot the release arms 108*c* of the clamping jaw member 108. Also, the station 42 may include a separation device as set forth in the previously mentioned patent application Ser. No. 573,492. After the packets have been separated from one another, the release bar 290 is moved downwardly, as shown in FIG. 15*c*, to release the individual packets from the carriage 12. The individual packets can be directed into a suitable shipping container (not shown) positioned below the removal station.

It should be noted that, while the foregoing description and the accompanying drawings have described and illustrated a machine for simultaneously producing three individual sealed packets, it will be appreciated that the method and apparatus of the present invention could readily be modified to produce a packet assembly having more or less individual packets.

In accordance with the provisions of the patent statutes, the principles and mode of operation of the present invention have been illustrated and described in what is considered to represent its preferred embodiment. However, it should be noted that the present invention may be practiced otherwise than as specifically illustrated and described without departing from the spirit or scope of the attached claims.

What is claimed is:

1. A method of packaging a product under vacuum comprising the steps of:

(a) forming an open top packet from a sheet of flexible packaging material;

(b) introducing the product into the open top packet;

(c) inserting a vacuum tube into the open top packet between facing sidewall portions of the packet;

(d) urging the facing surfaces of the sidewall portions against each other and against an outer surface portion of the vacuum tube to temporarily seal the open top packet around the vacuum tube;

(e) subjecting the interior of the packet to a vacuum through the vacuum tube; and (f) simultaneously with steps (d) and (e), permanently sealing the facing surfaces of the sidewalls together at a location below the lower end of the vacuum tube to close the packet whereby the product therein is sealed under vacuum in the packet.

2. The method defined in claim 1 wherein the seal produced in step (f) is an initial top seal spaced below the upper marginal edges of the sidewalls and including, subsequent to step (f), the steps of sealing the sidewalls together at a location above the initial top seal to produce a final top seal.

3. The method defined in claim 2 wherein the final top seal is produced after the vacuum tube is completely withdrawn from the packet.

4. The method defined in claim 2 including, subsequent to step (f), the step of stretching the upper portions of the sidewalls of the packet in a generally horizontal direction above the initial top seal for urging the upper portions of the sidewalls together during the final top seal operation.

5. The method defined in claim 1 where step (b) includes the step of maintaining the upper marginal edges of the packet in spaced apart relationship during the time when the product is introduced into the packet.

6. The method defined in claim 1 including, prior to step (c), the step of partially sealing the upper open portion of the packet to reduce the size of the opening of the packet while simultaneously maintaining a selected upper portion of the side walls of the packet in spaced apart relationship during the partial sealing operation.

7. The method defined in claim 1 including the step of producing a slit extending into at least one of the side marginal edges of the packet.

8. The method defined in claim 1 including, prior to step (e), the step of shaping the sidewalls of the packet.

9. The method defined in claim 1 wherein step (a) includes the steps of:

(a1) forming a channel-shaped member having spaced apart, generally vertically extending sidewalls from a flexible sheet of packaging material; and (a2) sealing the facing surfaces of the vertically extending sidewalls at horizontally spaced apart locations for defining at least one open top packet.

10. The method as defined in claim 1 wherein step (a) includes the steps of:

(a1) providing a generally horizontally disposed segment of sheet packaging material at a predetermined position;

(a2) urging a central portion of the segment vertically downwardly relative to the side portions of the segment to form a channel-shaped member having a bottom wall and vertically extending spaced apart opposed sidewalls;

(a3) maintaining a vertically extending selected portion of the opposed side walls in generally parallel spaced apart relationship; and (a4) simultaneously with step (a3), sealing the opposed sidewalls together at horizontally spaced apart locations positioned on opposite sides of said selected portion and extending upwardly from the bottom wall toward the upper end of the sidewalls for producing the open top packet.

11. The method defined in claim 1 wherein step (c) includes the step of inserting the vacuum tube into the open top packet to a first predetermined depth and, during step (e) and prior to step (f), partially withdrawing the vacuum tube to a second predetermined depth above said first predetermined depth.

12. An apparatus for packaging a product under vacuum comprising:

means for forming an open top packet from a sheet of flexible packaging material;

means for introducing a product into the open top packet;

means for inserting a vacuum tube into the open top packet between facing sidewall portions of the packet;

means for urging the facing surfaces of the sidewall portions against each other and against an outer surface portion of said vacuum tube to temporarily seal the open top packet around said vacuum tube;

means for subjecting the interior of the packet to a vacuum through said vacuum tube; and means for permanently sealing the facing surfaces of the sidewalls together at a location below the lower end of said vacuum tube to close the packet during the time wherein the interior of the packet is being subjected to a vacuum through said vacuum tube whereby the product is sealed under vacuum in the packet.

13. The apparatus defined in claim 12 wherein said top sealing means is a first top sealing means adapted to produce an initial top seal spaced below the upper marginal edges of the sidewalls and said apparatus further includes a second top sealing means for sealing the sidewalls together at a location above the initial top seal for producing a final top seal.

14. The apparatus defined in claim 13 wherein said second top sealing means includes means for stretching the upper portions of the sidewalls of the packet in a generally horizontal direction above said initial top seal for urging the upper portions of the sidewalls towards one another during the final top seal operation.

15. The apparatus according to claim 13 including means for completely withdrawing said vacuum tube from the packet when the final top seal is produced.

16. The apparatus defined in claim 12 wherein said top sealing means includes means for stretching the upper portions of the sidewalls in a generally horizontal direction for urging the upper portions of the sidewalls toward one another during the sealing operation.

17. The apparatus defined in claim 12 wherein said means for introducing a product includes opening means for maintaining the open upper marginal edges of the packet in spaced apart relationship during the time when the product is introduced into the packet.

18. The apparatus defined in claim 17 wherein said means for introducing the product includes a metering device for dispensing a predetermined amount of the product into the open top packet, said metering device including:

a hopper for containing a supply of the product and having at least one outlet;

a main body defining at least one metering chamber;

adjusting means for varying the volume of said chamber; and means for moving said main body relative to said hopper from a first position wherein said chamber is in communication with said outlet of said hopper to receive the product to a second position wherein said chamber is disconnected from said hopper and the product contained in said chamber can be dispensed into the packet.

19. The apparatus defined in claim 18 wherein said metering device is adapted to simultaneously dispense a predetermined amount of the product into a plurality of open top containers, said main body including a plurality of metering chambers, said adjusting means adapted to simultaneously vary the volume of each of said chambers.

20. The apparatus defined in claim 17 wherein said opening means is movable between a first upper position wherein said opening means is spaced from the upper marginal edge of the packet to a second lower position wherein said opening means is inserted within the open end of the packet, and means for actuating said opening means to open said packet after said opening means has been moved to the lower position.

21. The apparatus defined in claim 12 including clamp means for shaping the sidewalls of the packet prior to subjecting the interior of the packet to vacuum pressure.

22. The apparatus defined in claim 12 including means for producing a slit extending into at least one of the side marginal edges of the packet.

23. The apparatus according to claim 12 wherein said means for inserting includes means for inserting said vacuum tube into the open top packet to a first predetermined depth and means for partially withdrawing said vacuum tube to a second predetermined depth above said first predetermined depth prior to the packet being closed by said means for sealing.

24. The apparatus according to claim 12 wherein said means for forming includes means for forming a channel-shaped member having spaced apart, generally vertically extending sidewalls from the flexible sheet of package material and also means for sealing the facing surfaces of the vertically extending sidewalls at horizontally spaced apart locations for defining at least one open top packet.

25. The apparatus defined in claim 12 wherein said means for forming includes:

channel forming means for urging a central portion of a generally horizontally disposed segment of sheet packaging material vertically downwardly relative to the side portions of said segment to form a channel-shaped member having a bottom wall and vertically extending opposed sidewalls; and side sealing means for sealing said opposed sidewalls together at horizontally spaced apart locations positioned on opposite sides of a vertically extending selected portion of the opposed sidewalls, said sealing locations extending vertically upwardly from the bottom toward the upper end of the sidewalls for producing at least one cavity open at the upper end, said side sealing means including means for maintaining said selected portion of the opposed sidewalls in generally parallel spaced apart relationship during the side sealing operation.

26. The apparatus defined in claim 12 including means for partially sealing the upper open portion of the packet to reduce the size of the opening of the packet while simultaneously maintaining a selected upper portion of the sidewalls of the packet in spaced apart relationship during the partial sealing operation.

27. The method defined in claim 1 wherein step (f) includes the step of initially stretching the upper portions of the sidewalls of the packet in a generally horizontal direction for urging the upper portions of the sidewalls toward one another during the sealing operation of step (f).

* * * * *